US007409934B2

(12) United States Patent
Lee et al.

(10) Patent No.: US 7,409,934 B2
(45) **Date of Patent: *Aug. 12, 2008**

(54) SYSTEM FOR VARIABLE VALVETRAIN ACTUATION

(75) Inventors: Jongmin Lee, Pittsford, NY (US); Jeffrey D. Rohe, Caledonia, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/546,858

(22) Filed: Oct. 12, 2006

(65) Prior Publication Data

US 2007/0125330 A1 Jun. 7, 2007

Related U.S. Application Data

(63) Continuation-in-part of application No. 11/294,223, filed on Dec. 5, 2005.

(51) Int. Cl.
*F01L 1/34* (2006.01)

(52) U.S. Cl. ..... 123/90.16; 123/90.39; 74/569

(58) Field of Classification Search ..... 123/90.16, 123/90.2, 90.39, 90.44; 74/53, 55, 559, 567, 74/569

See application file for complete search history.

(56) References Cited

U.S. PATENT DOCUMENTS

| | | | | |
|---|---|---|---|---|
| 5,937,809 | A | 8/1999 | Pierik et al. | |
| 6,019,076 | A * | 2/2000 | Pierik et al. | 123/90.16 |
| 6,311,659 | B1 | 11/2001 | Pierik | |
| 6,354,255 | B1 * | 3/2002 | Methley et al. | 123/90.16 |
| 6,591,798 | B2 * | 7/2003 | Hendriksma et al. | 123/90.16 |
| 6,997,153 | B2 | 2/2006 | Schon et al. | |

* cited by examiner

*Primary Examiner*—Ching Chang
(74) *Attorney, Agent, or Firm*—Michael D. Smith

(57) ABSTRACT

An electromechanical VVA system for controlling the poppet valves in the cylinder head of an internal combustion engine. The system varies valve lift, duration, and phasing in a dependent manner for one or more banks of engine valves. A rocker subassembly for each valve is pivotably disposed in roller bearings on a rocker pivot shaft between the camshaft and a roller follower. A control shaft supports the rocker pivot shaft for controlling a plurality of rocker subassemblies mounted in roller bearings for a plurality of engine cylinders. The control shaft rotates about its axis to displace the rocker pivot shaft and change the angular relationship of the rocker subassembly to the camshaft, thus changing the valve opening, closing, lift and duration. An actuator attached to the control shaft includes a worm gear drive for positively rotating the control shaft.

13 Claims, 24 Drawing Sheets

8
28
30a
30
32
30a
14
31
10
13

8
28
13
11
14
12
10

8
33
7
28
14
10
13

23
43
42
42
8
44

34
39
9
47
49
48
50
41
8
23
42
42
45
46

300
23
52
53
35
39
9
41
41
40
3
26
42
8
34

SYSTEM FOR VARIABLE VALVETRAIN ACTUATION

RELATIONSHIP TO OTHER APPLICATIONS AND PATENTS

The present invention is a Continuation-In-Part of a pending U.S. patent application Ser. No. 11/294,223, filed Dec. 5, 2005.

This invention was made with United States Government support under Government Contract/Purchase Order No. DE-FC26-05NT42483. The Government has certain rights in this invention.

TECHNICAL FIELD

The present invention relates to valvetrains of internal combustion engines; more particularly, to devices for controlling the timing and lift of valves in such valvetrains; and most particularly, to a system for variable valvetrain actuation wherein a mechanism for variable actuation is interposed between the engine camshaft and the valve train cam followers to vary the timing and amplitude of follower response to cam rotation.

BACKGROUND OF THE INVENTION

One of the drawbacks inhibiting the introduction of a gasoline Homogeneous Charge Compression Ignited (HCCI) engine in production has been the lack of a simple, cost effective, and energy-efficient Variable Valvetrain Actuation (VVA) system to vary one or both of the exhaust and intake events. Many electro-hydraulic and electro-mechanical VVA systems have been proposed for gasoline HCCI engines, but while these systems may consume less or equivalent actuation power at low engine speeds, they typically require significantly more power than a conventional fixed-lift and fixed-duration valvetrain system to actuate at mid and upper engine speeds. Moreover, the cost of these systems can approach the cost of an entire conventional engine itself.

As the cost of petroleum continues to rise from increased global demands and limited supplies, the fuel economy benefits of internal combustion engines will become a central issue in their design, manufacture, and use at the consumer level. In high volume production applications, applying a continuously variable valvetrain system to just the intake side of a gasoline engine in an Early Intake Valve Closing (EIVC) strategy can yield fuel economy benefits up to 10% on Federal Test Procedure—USA (FTP) or New European Driving Cycle (NEDC) driving schedules, based on simulations and vehicle testing. HCCI type combustion processes have promised to make the gasoline engine nearly as fuel efficient as a conventional, 4-stroke Diesel engine, yielding gains as high as 15% over conventional (non-VVA) gasoline engines for these same driving schedules. The HCCI engine could become strategically important to the United States and other countries dependent on a gasoline-based transportation economy.

Likewise, the use of a continuously variable valvetrain for both the intake and exhaust sides of a Diesel engine has been identified as a potential means to reduce the size and cost of future exhaust aftertreatment systems and a way to restore a portion of the lost fuel economy that these systems presently impose. By varying the duration of intake lift events, potential Miller cycle-type fuel economy gains are feasible. Also, with VVA on the intake side, the effective compression ratio can be varied to provide a high ratio during startup and a lower ratio for peak fuel efficiency at highway cruise conditions. Without intake side VVA, compression ratios must be compromised in a tradeoff between these two extremes. Exhaust side VVA can improve the torque response of a Diesel engine. Varying exhaust valve opening times can permit faster transitions with the turbocharger, thereby reducing turbo lag. Exhaust VVA can also be used to expand the range of engine operation wherein pulse turbo-charging can be effective. Furthermore, varying exhaust valve opening times can be used to raise exhaust temperatures under light load conditions, significantly improving NOx adsorber efficiencies.

VVA devices for controlling the timing of poppet valves in the cylinder head of an internal combustion engine are well known.

For a first example, U.S. Pat. No. 5,937,809 discloses a Single Shaft Crank Rocker (SSCR) mechanism wherein an engine valve is driven by an oscillatable rocker cam that is actuated by a linkage driven by a rotary eccentric, preferably a rotary cam. The linkage is pivoted on a control member that is in turn pivotable about the axis of the rotary cam and angularly adjustable to vary the orientation of the rocker cam and thereby vary the valve lift and timing. The oscillatable cam is pivoted on the rotational axis of the rotary cam. In the case of an SSCR mechanism, a separate spring is needed to return the oscillating mechanism to its base circle position.

For a second example, U.S. Pat. No. 6,311,659 discloses a Desmodromic Cam Driven Variable Valve Timing (DCDVVT) mechanism that includes a control shaft and a rocker. A second end of the opening rocker arm is connected to a control member. The rocker carries a first roller for engaging a valve opening cam lobe of an engine camshaft and a second roller for engaging a valve closing cam lobe of an engine camshaft. A link arm is pivotally coupled at a first end thereof to the first end of the opening rocker arm. An output cam is pivotally coupled to the second end of the link arm, and engages a roller of a corresponding cam follower of the engine. Thus, the valve opening and valve closing cam lobes cooperate to provide a positive opening and closing motion of the mechanism. While the engine valve return springs bias the rollers of the cam followers into contact with the output cam lobes, the cooperating valve opening and valve closing cam lobes avoid the need for a separate spring to return the oscillating mechanism to its starting position.

A shortcoming of these two prior art VVA systems is that both the SSCR device and the DCDVVT mechanism include two individual frame structures per each engine cylinder that are somewhat difficult to manufacture.

Another shortcoming is that the frame structures of these mechanisms "hang" from the engine camshaft and thus create a parasitic load.

An additional shortcoming of the SSCR mechanism is its significant reciprocating mass. The input rocker is connected through a link to two output cams that also ride on the input camshaft. Because the mechanism comprises four moving parts per cylinder, it is difficult to provide a return spring stiff enough for high-speed engine operation that can still fit in the available packaging space.

Still another shortcoming is that assembly and large-scale manufacture of such an SSCR device would be difficult at best with its large number of parts and required critical interfaces.

For a third example, U.S. Pat. No. 6,997,153 discloses a drive system for continuously changing lift characteristics of the charge-cycle valves while the engine is in operation. The drive consists of a housing, a cam, an intermediate element, and a valve-actuating output element. The cam is mounted in the housing, for example, in the cylinder head, in a turning joint and actuates the intermediate element which also is mounted in a turning joint in the housing. The intermediate element is connected to the output element via a cam joint formed at the contact point of the intermediate element, having a base circle portion (stop notch) and a control section, and the output element which may include a follower roller. The output element is also mounted in a turning joint in the housing and transmits motion to a valve stem. A change in valve lift characteristics is effected by changing the position of the intermediate element turning point or the output element turning joint via an eccentric element in the housing for either the intermediate element or the output element.

In the third example, while no indication is provided of a practical structure for implementing this arrangement, significant manufacturing and control complexity would exist in providing for, and controlling the action of, eccentric control shafts for both the intermediate and output elements.

What is needed in the art is a simplified VVA mechanism that is not mounted on the engine camshaft, is easy to manufacture and assemble, requires only a single angular control element, and requires minimal packaging space in an engine envelope.

It is a principal object of the present invention to provide variable opening timing, closing timing, and lift amplitude in a bank of engine intake and/or exhaust valves.

It is a further object of the invention to simplify the manufacture and assembly of a VVA system for such variable opening, closing, and lift.

It is a still further object of the invention to provide such a system which is not parasitic on the engine camshaft.

SUMMARY OF THE INVENTION

Briefly described, the invention contained herein comprises a VVA system for controlling one or more poppet valves in the cylinder head of an internal combustion engine. The system varies valve lift, duration, and phasing in a dependent manner for one or more banks of engine valves. Using a single rotary actuator per bank of valves to control the device, the valve lift events can be varied for either the exhaust or intake banks. Two such systems are required to accommodate both the exhaust and intake banks of valves.

The device comprises a hardened steel rocker subassembly for each valve (or valve pair) pivotably disposed in needle roller bearings on a rocker pivot shaft disposed between the engine camshaft and the engine roller finger follower. A one-piece control shaft supports the rocker pivot shaft for controlling a plurality of valve trains for a plurality of cylinders in an engine bank. The control shaft itself is rotated about its axis to displace the rocker pivot shaft along an arcuate path and hence change the angular relationship of the rocker subassembly to the camshaft, thus changing the valve opening, closing, and lift. Valve actuation energy comes from a conventional mechanical camshaft driven conventionally by a belt or chain. The control shaft actuator may be an electric motor attached to the control shaft. The actuator preferably includes a worm gear drive for positively rotating the control shaft without gear lash.

Compared to prior art devices, an important advantage of the present mechanism is its simplicity. The input and output oscillators of the prior art are continuously variable valvetrain devices, such as the SSCR and the DCDVVT, have been combined into one moving part. Due to its inherent simplicity, the present invention differs significantly from the original SSCR device in its assembly procedure for mass production. With only one oscillating member, the present invention accrues significant cost, manufacturing, and mechanical advantages over these previous designs. Further, a VVA device in accordance with the present invention does not "hang" from the camshaft, as is the case with these other mechanisms, but rather is supported on an engine head by its own arbors and journals, and therefore is not parasitic on the camshaft. Because there are fewer mechanical parts, there are fewer degrees of freedom in the mechanism. This simplifies the task of design optimization to meet performance criteria by substantially reducing the number of equations required to describe the motion of the present device. Further, a device in accordance with the invention requires approximately one-quarter the total number of parts as an equivalent SSCR device for a similar engine application. With its cost advantages and design flexibility, the present device can easily be applied to the intake camshaft of a gasoline engine for low cost applications, or to both the intake and exhaust camshafts of a Diesel or a gasoline HCCI engine.

BRIEF DESCRIPTION OF THE DRAWINGS

The present invention will now be described, by way of example, with reference to the accompanying drawings, in which.

The exemplifications set out herein illustrate several embodiments of the invention, including at least one preferred embodiment, and such exemplifications are not to be construed as limiting the scope of the invention in any manner.

DESCRIPTION OF THE PREFERRED EMBODIMENTS

The benefits and advantages of a VVA system in accordance with the invention may be better appreciated by first considering a prior art engine valvetrain without VVA.

Figure 1B:
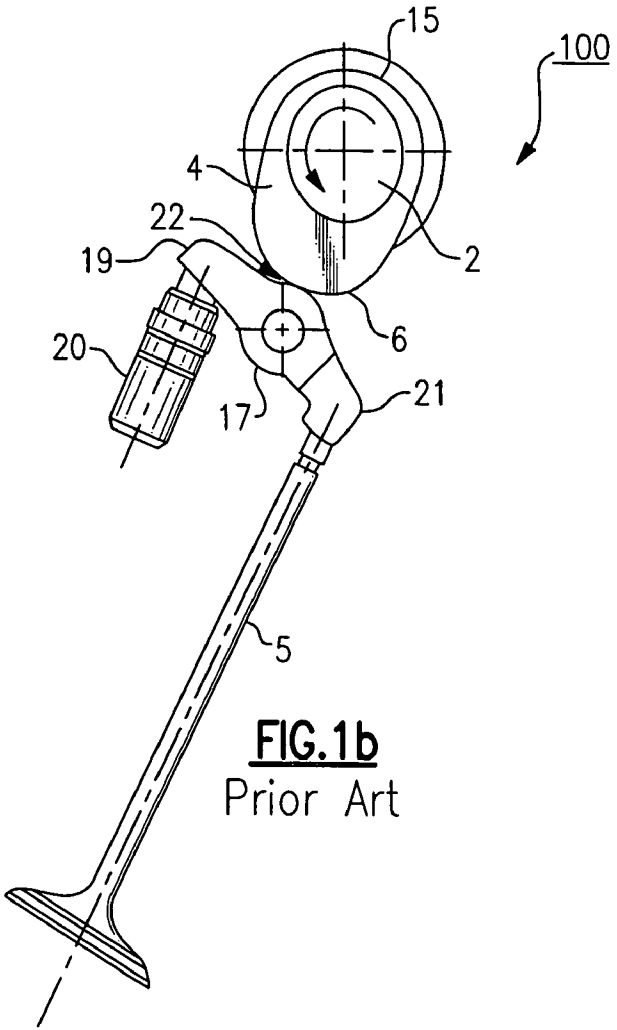
FIG. 1b Prior Art
FIG. 1*b* is a drawing like that shown in FIG. 1*a*, showing the valve in a fully open position.
Figure 1A:
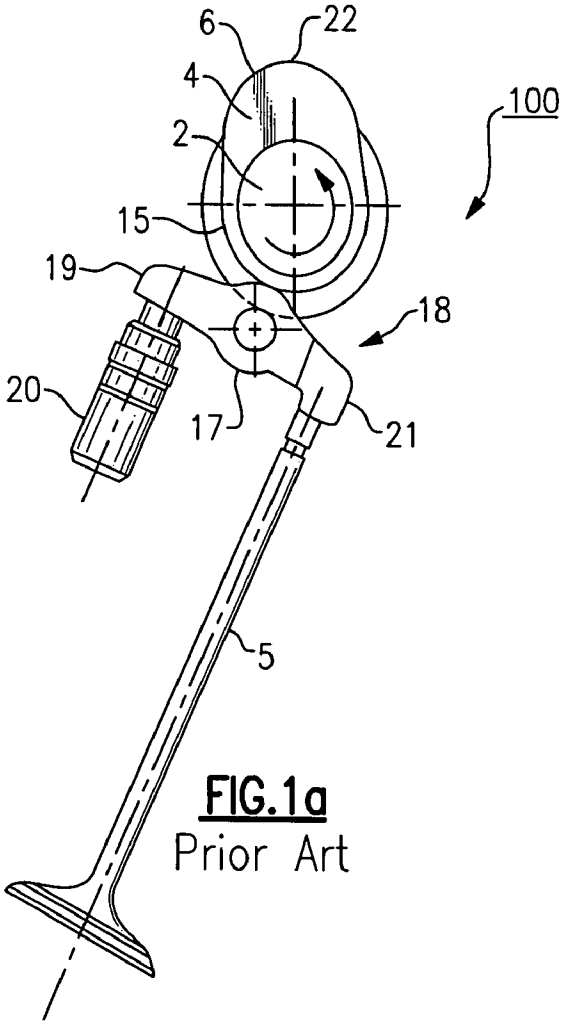
FIG. 1a Prior Art
FIG. 1*a* is an elevational drawing of a prior art valvetrain without VVA, showing the valve in the fully closed position.

Referring to FIGS. 1*a* and 1*b*, a prior art valvetrain 100 comprises an input engine camshaft 2 having a cam lobe 4. Lobe 4 is defined by a profile having a base circle portion 15, an opening flank 6, and a nose portion 22. A roller finger follower (RFF) 18 includes a centrally mounted roller 17 for following cam lobe 4 and is pivotably mounted at a first socket end 19 on a hydraulic lash adjuster 20. A second pallet end 21 of RFF 18 engages the stem end of an engine valve 5. When RFF 18 is on the base circle portion 15, valve 5 is closed, as shown in FIG. 1*a*. As camshaft 2 rotates counter-clockwise, RFF 18 begins to climb opening flank 6, forcing valve 5 to begin opening. When RFF 18 reaches nose portion 22, valve 5 is fully open, as shown in FIG. 1*b*. Further rotation of camshaft 2 causes valve 5 to gradually close as RFF 18 moves down the closing flank of the cam lobe and returns to base circle portion 15. Note that in prior art valvetrain 100, the valve opening and closing timing and the height of valve lift are fixed by the cam lobe profile and are invariant.

Referring now to FIGS. 2*a*-11, an improved VVA valvetrain system 200 in accordance with the invention, shown in elevation for a typical engine valve, includes a control shaft assembly 1 shown at the intake valve camshaft 2 of an engine 102 which may be spark-ignited or compression-ignited. In the present exemplary arrangement, the valvetrains include two intake valves per cylinder of a multi-cylinder engine.

Figure 2B:
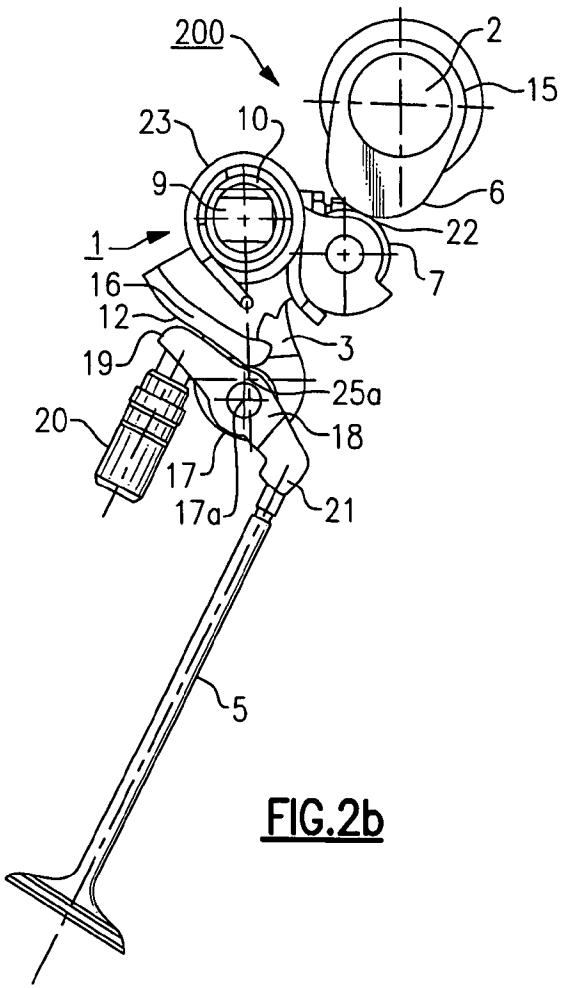
FIG. 2*b* is a drawing like that shown in FIG. 2*a*, showing the VVA in maximum lift position and the valve in the fully open position.
Figure 2A:
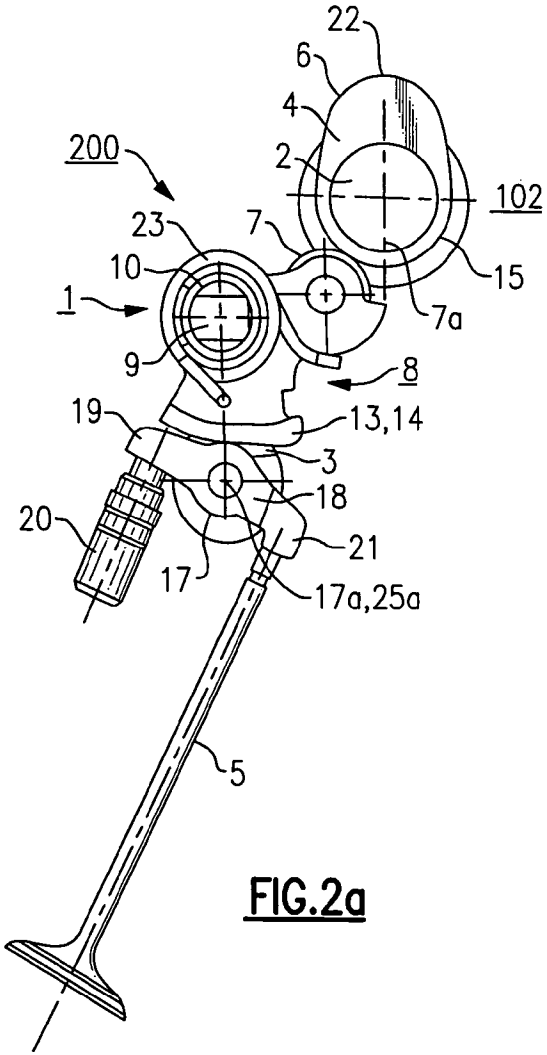
FIG. 2*a* is an elevational drawing of an improved valvetrain equipped with VVA means in accordance with the invention, showing the VVA in maximum lift position and the valve in the fully closed position.

Control shaft assembly 1 manages an engine's gas flow process by varying the angular position of its control shaft. In FIGS. 2*a* and 2*b*, system 200 is shown in its full engine load position, and in FIGS. 3*a* and 3*b*, system 200 is shown in its lowest engine load position. In FIGS. 2*a*,3*a*, a view of system 200 with the input camshaft on its base circle appears, and in FIGS. 2*b*,3*b* a view with the input cam at its peak lift point appears. Note that actuator control shaft segment 38 has been removed for clarity in FIGS. 2 and 3.

As shown in FIGS. 2*a*,2*b*, high lift events with full duration are produced by the system whenever the control shaft arms 3 are in the first (nearly vertical) position indicated. (For convenience in the following discussion, such terms as vertical, horizontal, above, and below are used in the sense as the elements appear in the figures; of course, it will be recognized that in an actual installation the directional relationships among the elements may be different.)

Figure 3B:
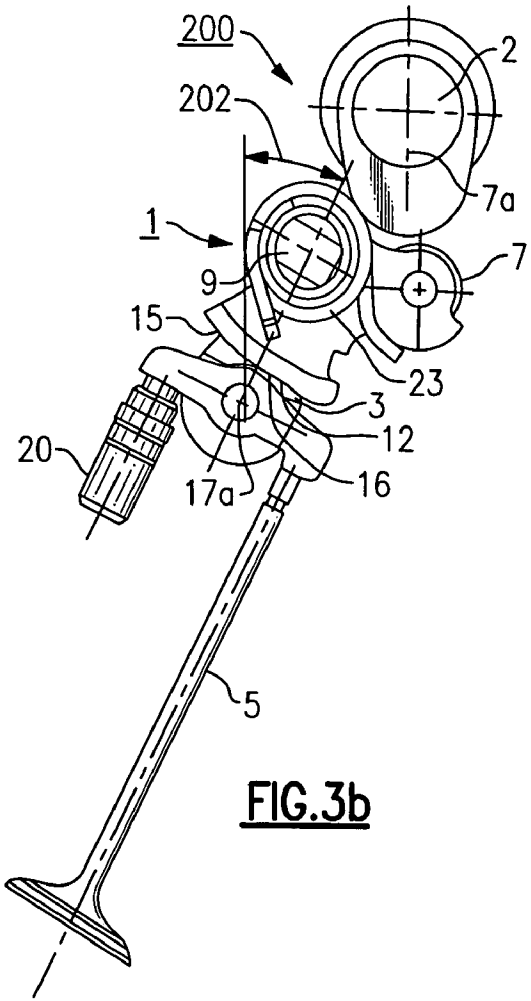
FIG. 3*b* drawing like that shown in FIG. 3*a*, showing the VVA in minimum lift position and the valve in the fully open position.
Figure 3A:
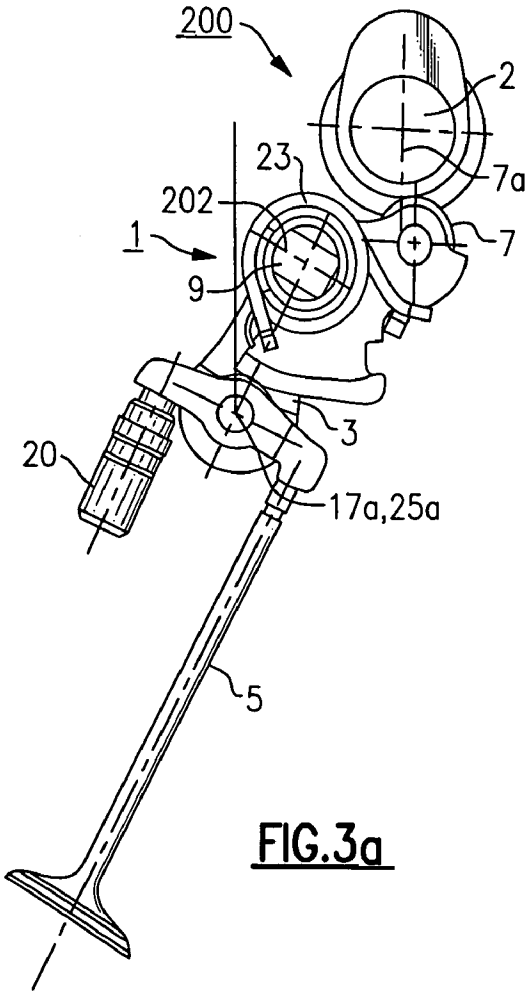
FIG. 3*a* is a drawing like that shown in FIG. 2*a*, showing the VVA in minimum lift position and the valve in the fully closed position.
Figure 4:
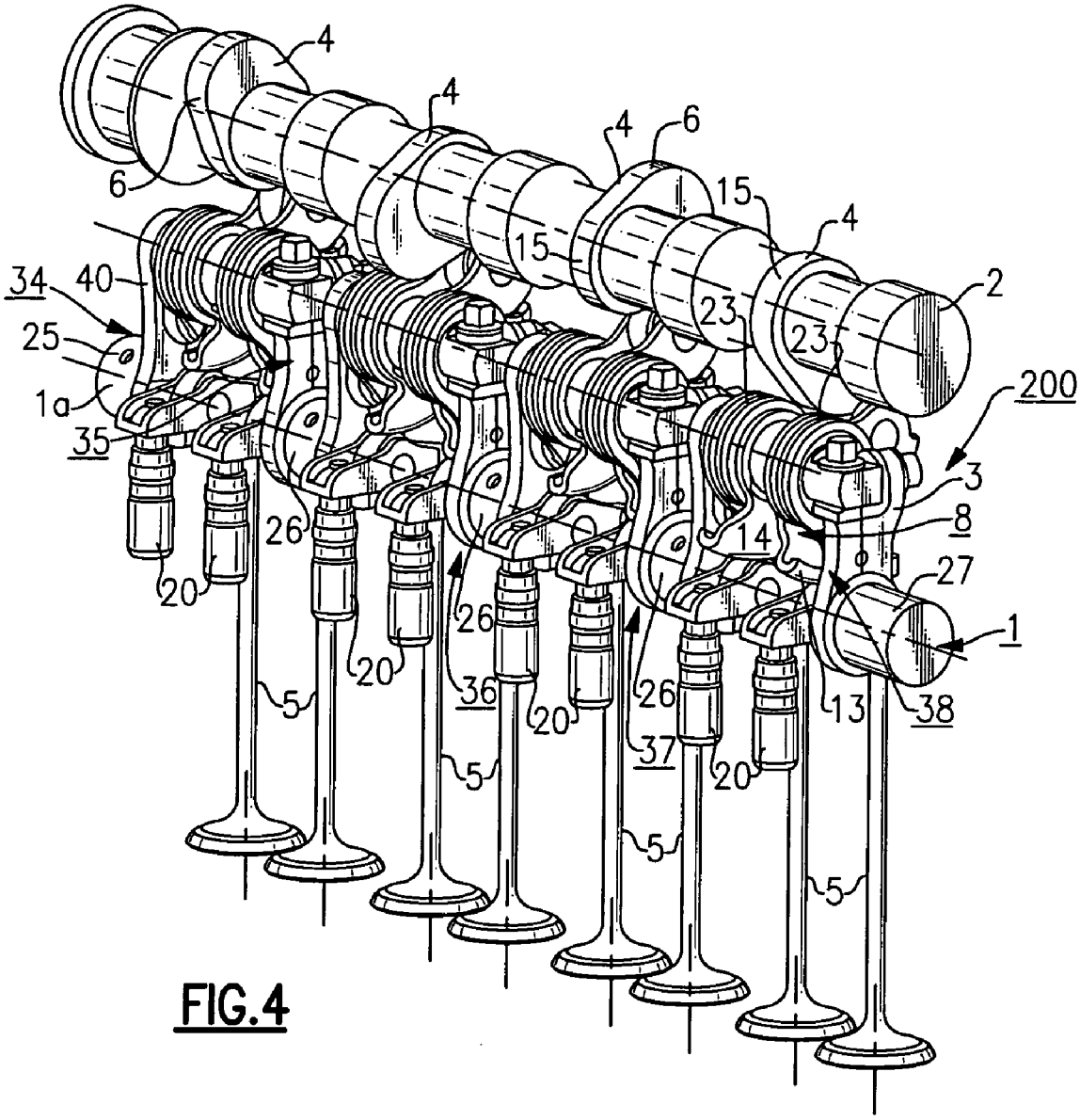
FIG. 4 is an isometric drawing of four valvetrains for a four-cylinder engine bank, the valvetrains being equipped with VVA means linked together.

As seen in FIG. 4, and also referring to FIGS. 2*a*,2*b*,3*a*,3*b*, at each engine cylinder is a cam lobe 4, integral to a nodular cast iron input camshaft 2, centered axially between two engine valves 5. As input camshaft 2 rotates counter-clockwise, urged by an engine crankshaft and chain or pulley (not shown), opening flank 6 of cam lobe 4 pushes hardened steel rocker roller 7 down, causing the stamped steel rocker subassembly 8 to rotate in a clockwise direction about a forged steel (or cast iron) control shaft rocker pivot pin 9 of the lift control shaft assembly 1, one of which is located at each of the engine's cylinders. A mating bronze (or babbit) pivot bearing insert 10 facilitates rotation of rocker subassembly 8. When in the full engine load mode of operation (FIGS. 2*a*,2*b*), the locus of motion of rocker roller 7 is left of the centerline 7*a* of the input camshaft 2. Clockwise rotation of rocker subassembly 8 advances the output cam profiles 12 formed onto the folded and carbonized rocker flanges 13,14 to where the radius of output cam 16 increases beyond that of the base circle portion 15 of the cam profile. The further that rocker subassembly 8 is rotated about control shaft rocker pivot pin 9, the greater the lift imparted through finger follower rollers 17. The left end of each finger follower 18 pivots about the ball shaped tip of a conventional hydraulic valve lash adjuster 20. Pushing down on the centrally located finger follower roller 17 imparts lift to engine valve 5 via pallet 21 end on follower 18.

An important aspect and benefit of an improved VVA system in accordance with the invention is that no changes except relative location are required in the existing prior art camshaft, cam lobes, roller finger followers, hydraulic valve lifters, and valves. The only structural requirement in the engine is that the camshaft be removed farther from the HLA and RFF and offset slightly to permit insertion of VVA assembly 200 there between.

When control shaft assembly 1 is in the full lift position as shown in FIGS. 2*a*,2*b*, maximum lift is reached at engine valves 5 whenever rocker roller 7 reaches nose portion 22 of input cam lobe 4. At this point, rocker subassembly 8 ceases to rotate in the clockwise direction. As input cam lobe 4 rotates further in the counter-clockwise direction, nose portion 22 of camshaft lobe 4 slips past rocker roller 7, and helical torsion return spring 23 forces rocker subassembly 8 to rotate counter-clockwise. This counter-clockwise rotation, in turn, reduces lift produced between the output cam profiles 12 and finger follower rollers 17. Eventually, as camshaft 2 continues to rotate counter-clockwise, rocker roller 7 reaches base circle portion 15 of input cam lobe 4. Here, lift remains at zero, until the next engine event occurs in that cylinder. The motion described above produces a peak lift profile (FIG. 5, curve 210), similar to that produced by prior art system 100 as shown in FIGS. 1*a*,1*b*, to maximize gas flow to the engine.

Short shank pins 25, 26 and 27 in control shaft assembly 1 may ride, for example, in matching holes (not shown) which may be bored through the engine's camshaft bearing webs integral to the cylinder head. An electromechanical actuator (also not shown) rotates control shaft assembly 1 about the center of these holes to vary engine load. Note that the centerlines 25*a* of the control shaft shank pins 25, 26 and 27 coincide with the centerlines 17*a* of finger follower rollers 17 in FIGS. 2*a*,3*a*.

Figure 5:
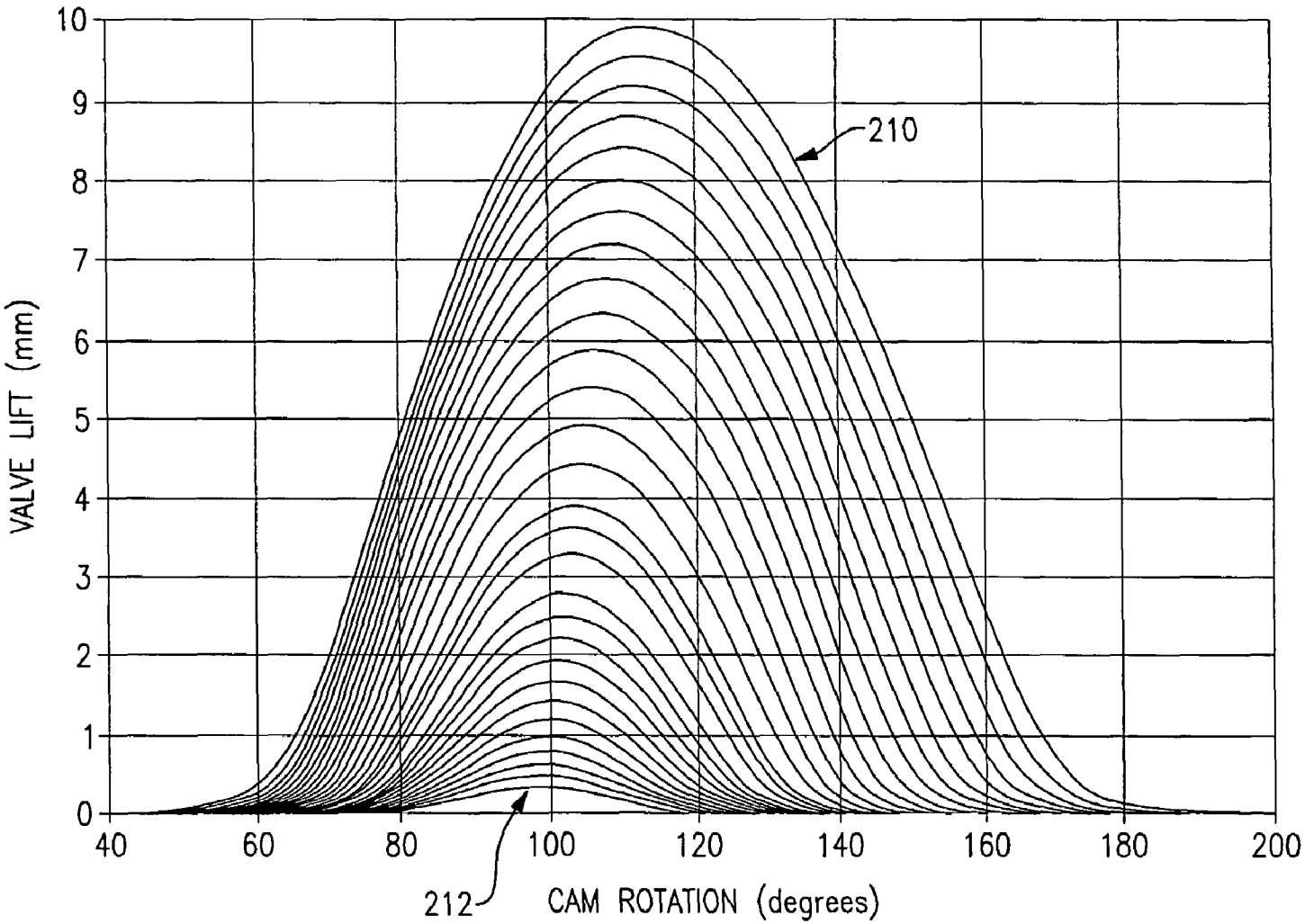
FIG. 5 is a graph showing a family of lift curves for a valvetrain equipped with VVA means in accordance with the invention, the curves being bounded by maximum lift of the apparatus shown in FIGS. 2*a* and 2*b*, and by minimum lift of the apparatus shown in FIGS. 3*a* and 3*b;*
Figure 6B:
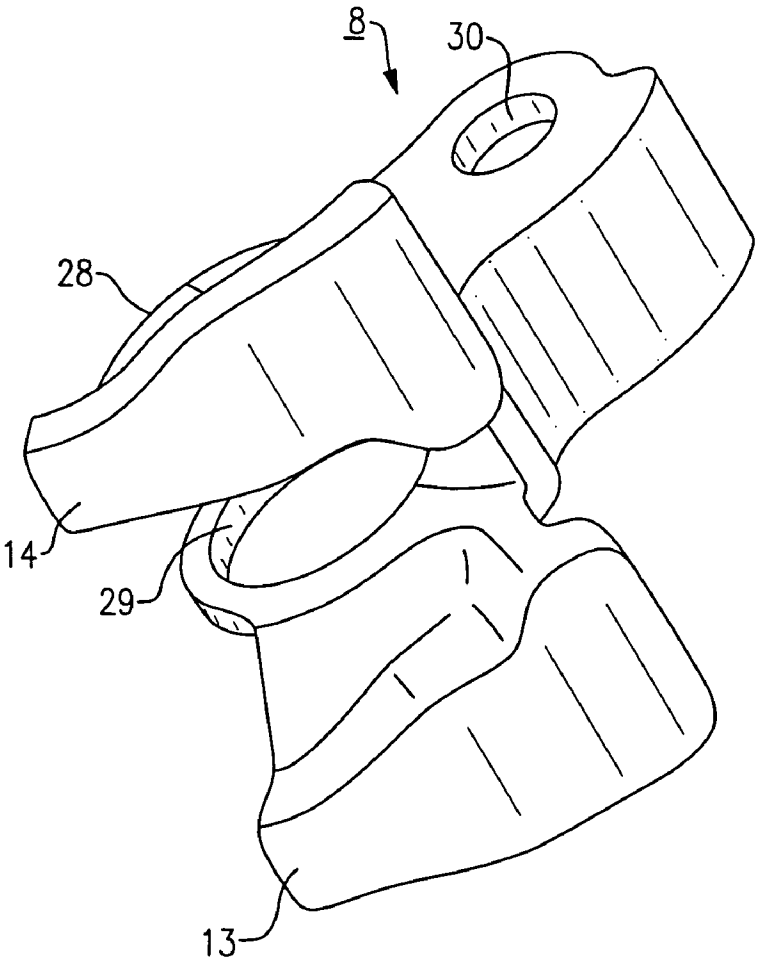
FIGS. 6*a* and 6*b* are isometric views from above and below, respectively, of a metal stamping for forming a VVA rocker frame.
Figure 6A:
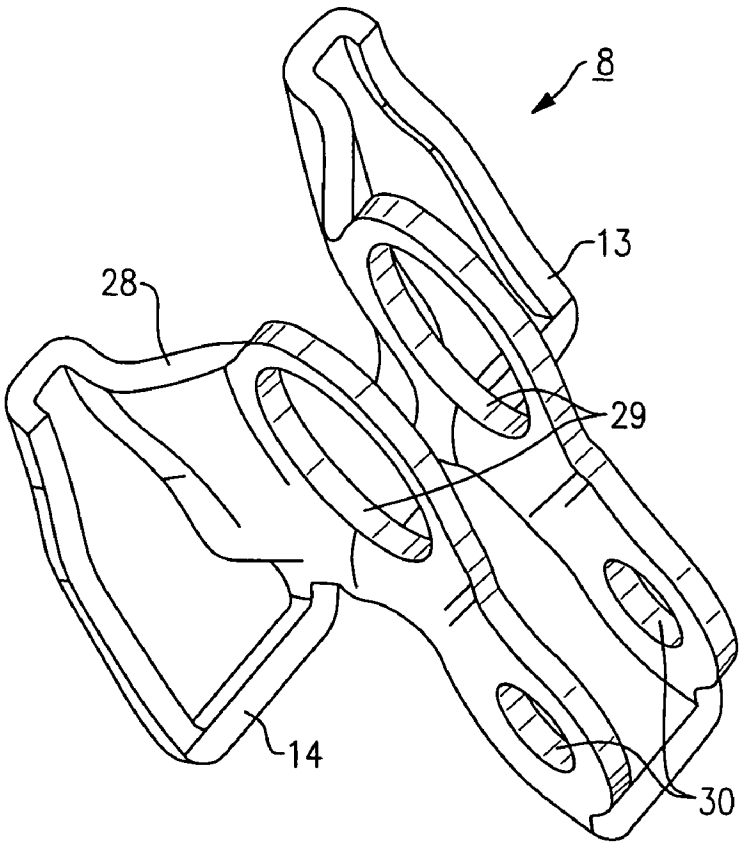
Figures 7A, 7B, 7C:
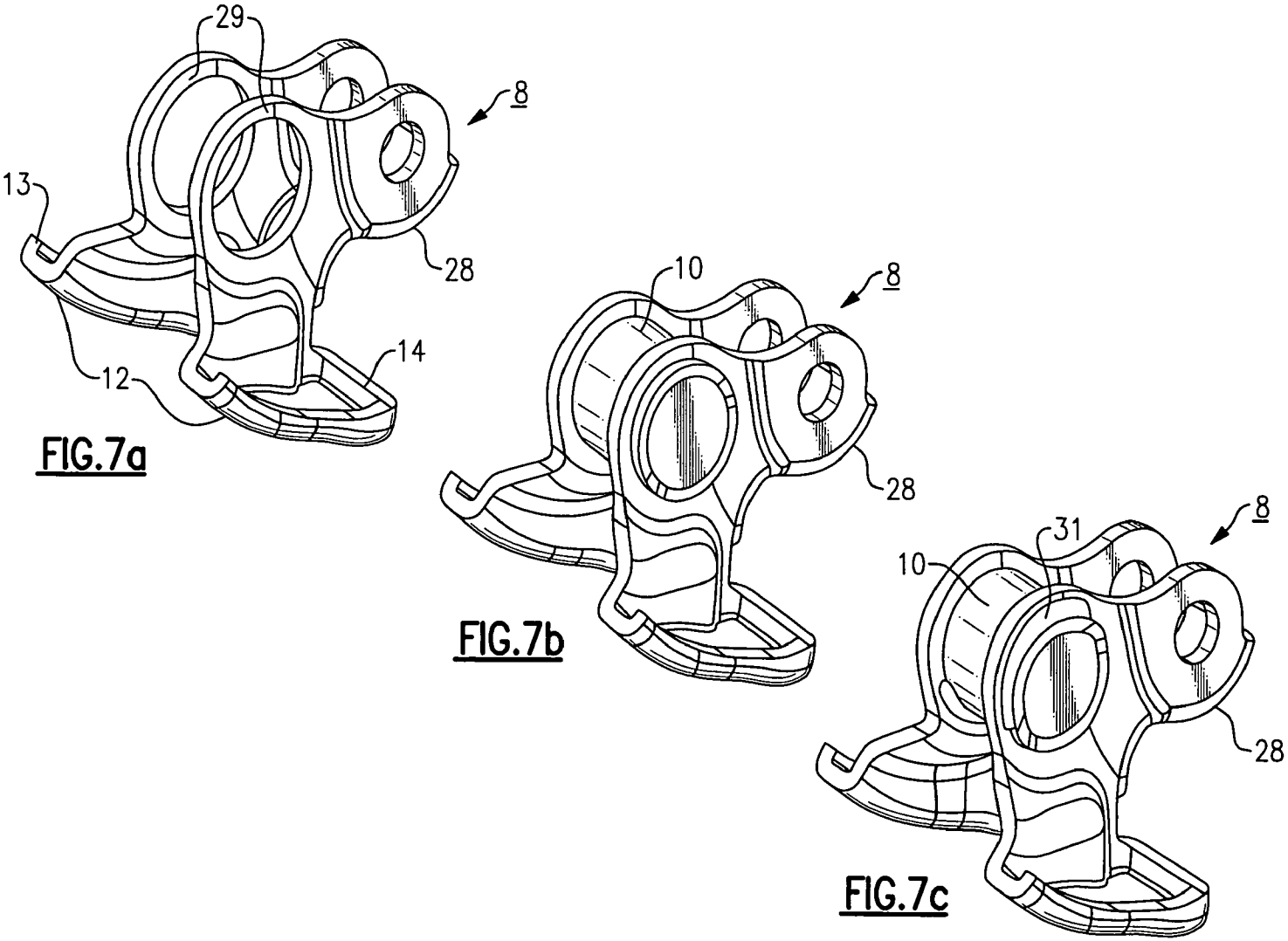
FIGS. 7*a*,7*b*,7*c*,8*a*,8*b*,8*c* are isometric views showing progressive steps in the manufacture and assembly of a VVA rocker.

Referring to FIGS. 3*a*,3*b*, if control shaft assembly 1 is rotated through an angle 202 clockwise on axis 17*a* from its full load position as shown in FIG. 2*a* (such as would be desirable under light engine load conditions), for example through about 27.5°, assembly 1 produces minimal lift events with reduced duration (also see curve 212 in FIG. 5). In this position (FIGS. 3*a*,3*b*), control shaft rocker pivot pins 9 are in their closest proximity to input camshaft 2, causing the loci of all rocker rollers 7 to oscillate just right of the centerline 7*a* of camshaft 2. Likewise, when control shaft assembly 1 is in the light load position, finger follower roller 17 spends most of its time on base circle portion 15 of output cam profile 12, just barely reaching opening flank 16 of the profile whenever rocker roller 7 is aligned with nose portion 22 of input camshaft lobe 4. Thus, assembly 1 produces short and shallow lift events (see FIG. 5, curve 212), which minimize gas flow to the engine.

Variably rotating control shaft assembly 1 to intermediate rotational positions between full engine load position (FIGS. 2*a*,2*b*) and minimum engine load position (FIGS. 3*a*,3*b*) produces the remaining lift curves (not numbered) within the family depicted in FIG. 5 between curves 210,212.

Figures 8A, 8B, 8C:
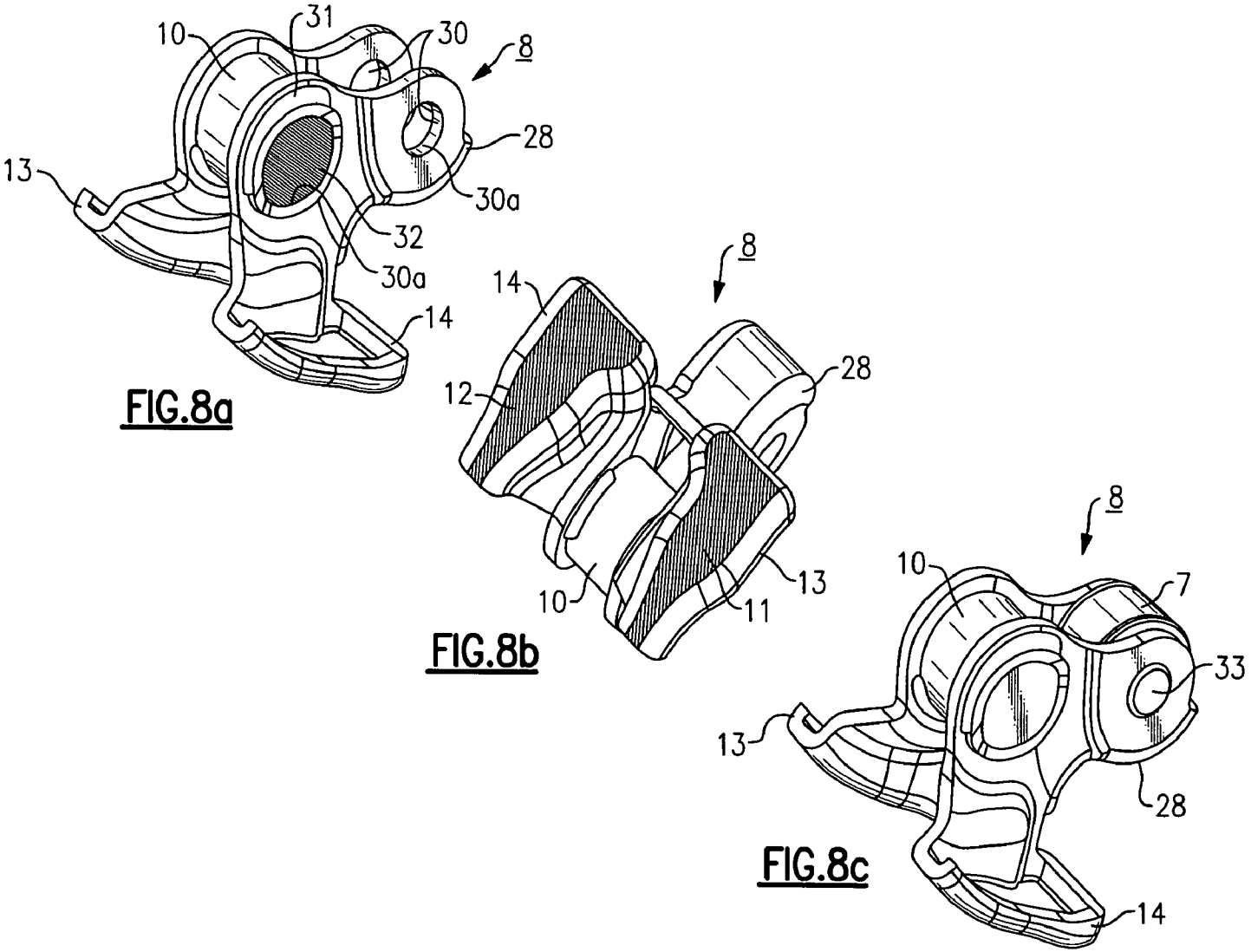

FIGS. 6*a* through 8*c* show sequential steps in formation of a stamped steel rocker subassembly 8. Each low carbon steel rocker frame 28 is stamped from sheet stock in a series of forming operations that may include punching in the rocker pivot bearing holes 29 and initial roller pin holes 30. Rocker flanges 13, 14 are then carbonized to increase their hardness. Bronze pivot bearing insert 10 is then inserted into holes 29 and is held in place by assembly jigs (not shown) and fixed into permanent position in a copper brazing process 31. In the next step (FIG. 8*a*) of manufacture, bearing through-hole 32 for control shaft rocker pivot pin 9 and roller pin holes 30 are reamed 30*a* to size and aligned with respect to the rocker flanges 13, 14. The final cam profiles 11, 12 may be ground onto the lower surfaces of rocker flanges 13, 14. A shaft spinning operation is employed to attach rocker roller 7, needle bearings (not shown), and retaining pin 33, providing a finished rocker sub-assembly 8 (FIG. 8*c*).

Engine cam 4 defines an input cam lobe to a valvetrain, and cam profiles 11, 12 define a variable-output cam lobe of system 200 to RFF 18.

Referring now to FIG. 4 and FIGS. 9*a*-*c* and 10*a*-*b*, the control shaft assembly 1 of first embodiment assembly 200 can be assembled from individual, nodular cast iron or forged steel segments 34,35,36,37,38, also referred to herein as control shaft sub-assemblies, to facilitate installation of the rocker sub-assemblies 8 and return springs 23. As noted above, when all the forged steel segments are assembled, control shaft 1 defines a control shaft for system 200. (As described below, in one aspect of the invention, the control shaft is provided as a single crankshaft unit.) At three of the cylinder locations are modular unit-control shaft segments 35,36,37, each comprising a slender control shaft rocker pivot pin 9, a wider shoulder section 39, and a pair of control arms 3,40 that straddle a head shank pin 26. Control shaft assembly 1 is terminated at its ends by a drive end control shaft segment 34 and an actuator control shaft segment 38, each of which has only one control shaft arm 3 and 40, respectively. The drive end control shaft segment 34 also includes a control shaft rocker pivot pin 9 and a shoulder section 39. All of the control shaft segments 34-38 contain diamond shaped, broached holes 41 for retention of the grounded end hooks 42 of return springs 23.

Figures 9A, 9B, 9C:
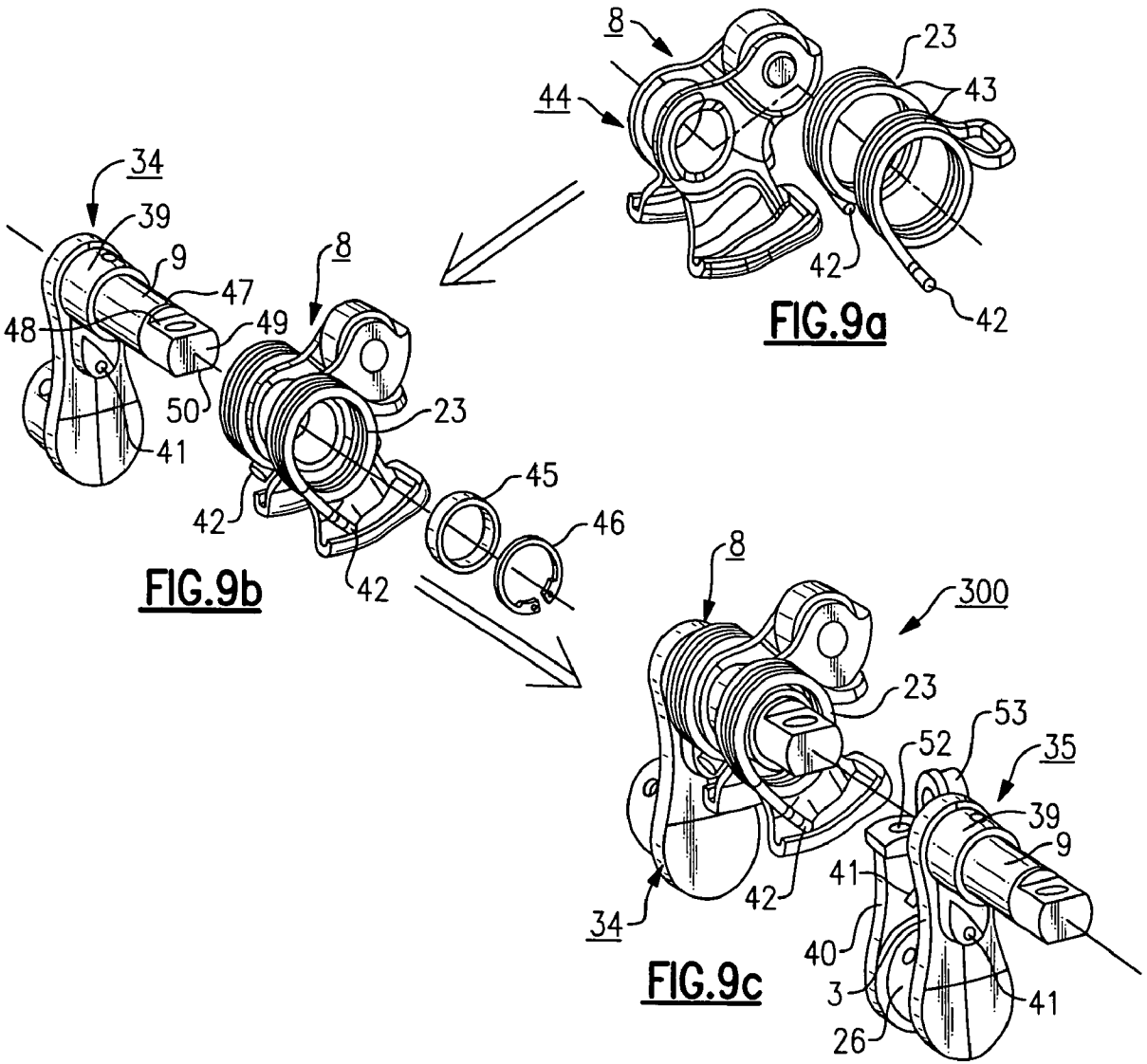
FIG. 9*a* is an exploded isometric view of a VVA rocker sub-assembly and return spring.
FIG. 9*b* is an exploded isometric view showing a first assembly of a VVA rocker sub-assembly and return spring of a control shaft element.
FIG. 9*c* is an exploded isometric view showing assembly of a second control shaft portion onto the first assembly shown in FIG. 9*b;*

Prior to the final assembly of system 200, the dual coils 43 of the helical, torsion return springs 23 are snapped in place over the closed middle section 44 and the pivot bearing insert 10 of each completed rocker sub-assembly 8 (see FIG. 9*a*). During assembly of a control shaft sub-assembly, the pivot bearing insert 10 of each rocker subassembly 8 and a hardened steel collar 45 are slid over the control shaft rocker pivot pin 9, while inserting one of the grounded end hooks 42 of each return spring into one of the broached holes 41 in the control shaft arms 3. The rocker subassembly 8 and steel collar 45 are retained axially against each shoulder section 39 by a common, external type snap ring 46 and a matching groove 47 in the circumference of each control shaft rocker pivot pin 9.

Figure 11:
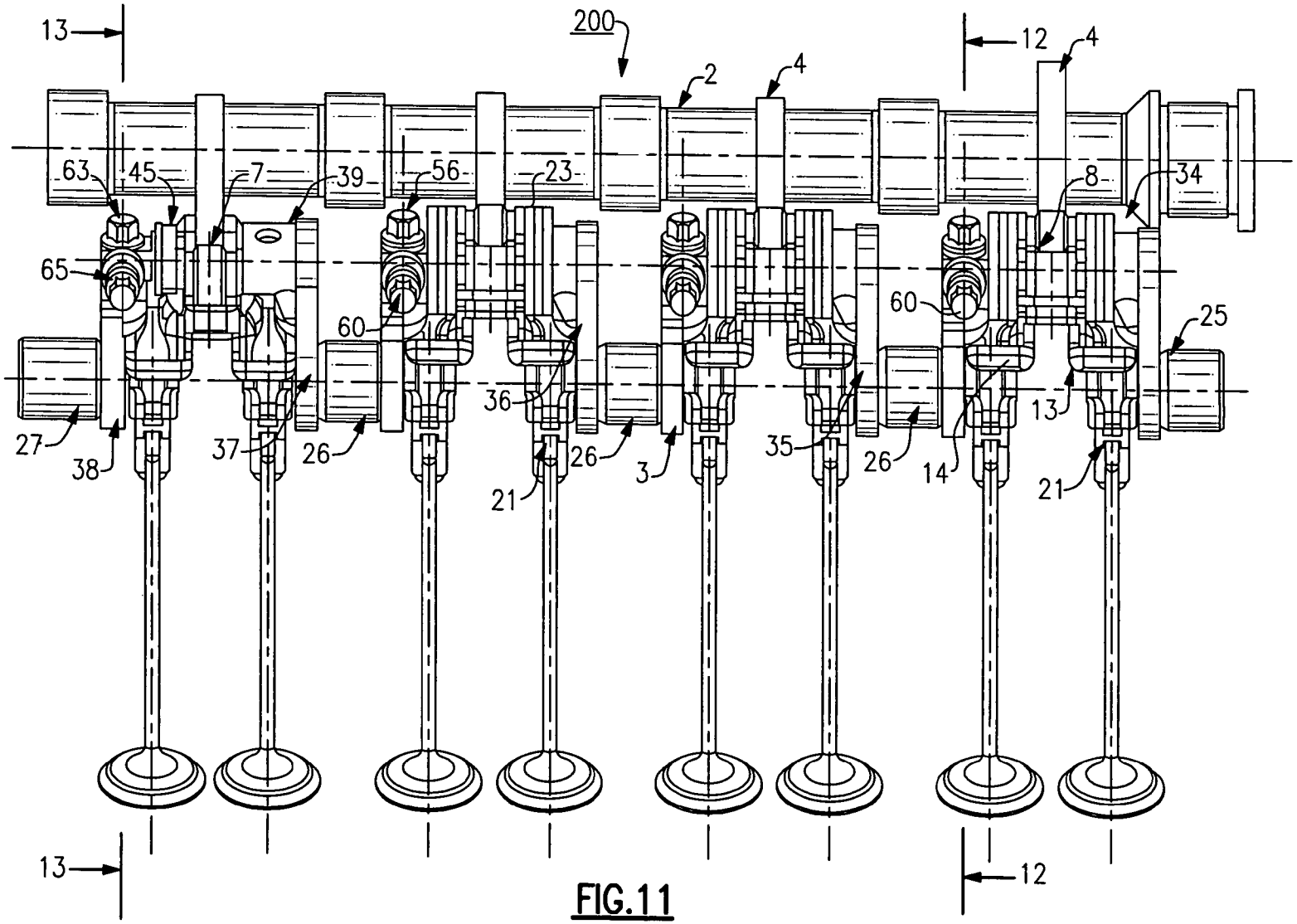
FIG. 11 is an elevational view of the valvetrains shown in FIG. 4.
Figure 13:
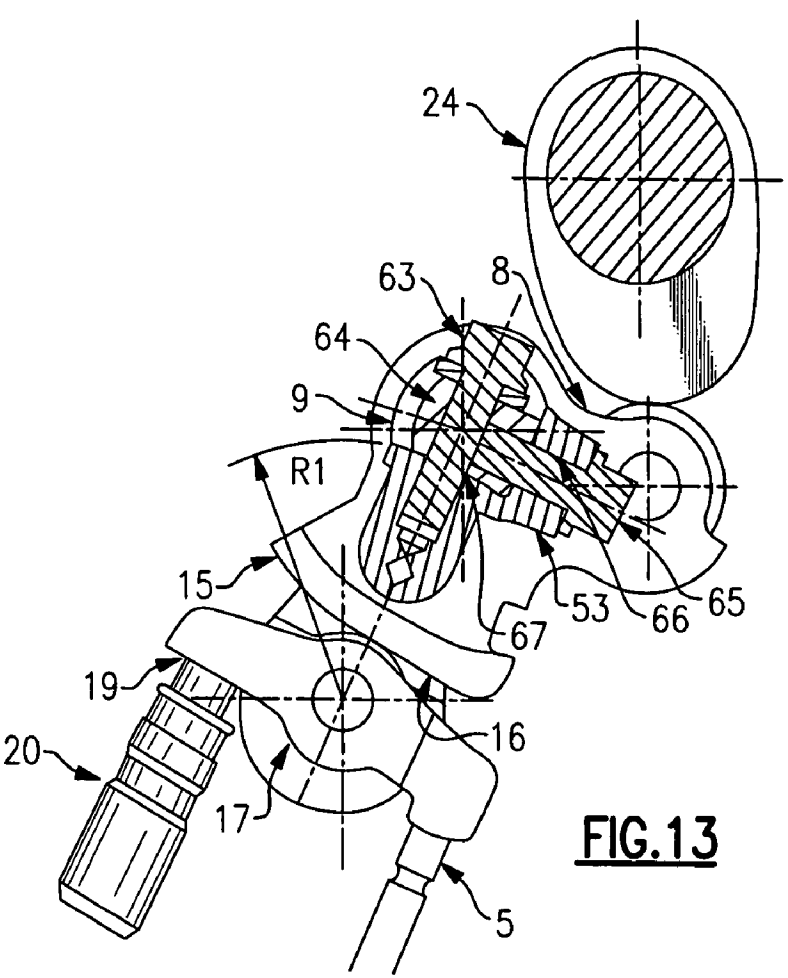
FIG. 13 is a cross-sectional view taken along line 13-13 in FIG. 11.
Figure 12:
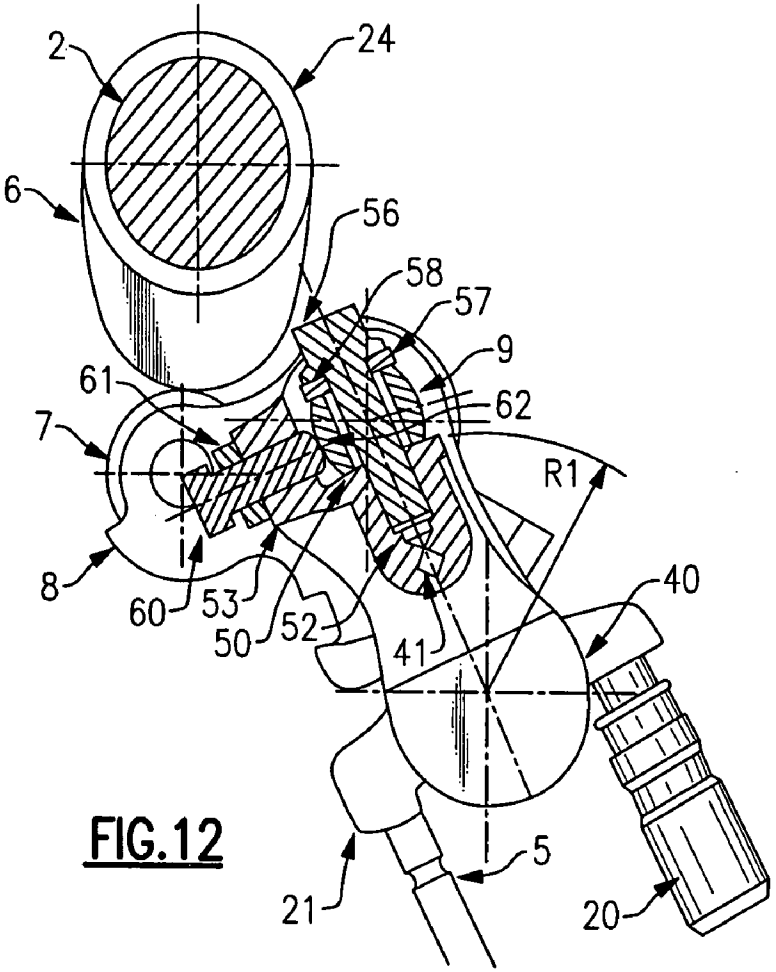
FIG. 12 is a cross-sectional view taken along line 12-12 in FIG. 11.

At the free end of each control shaft rocker pivot pin 9 are machined flats 48,49 and a cylindrically shaped arched pocket 50 of radius R1 (see FIGS. 12 and 13). Correspondingly, and referring now to FIGS. 10*a*,10*b*, at the opposite end of the unit-control shaft segments 35,36,37 and the actuator control shaft segment 38 is a notched control arm 40, complete with a mating arched flange 51 of radius R1, a blind, threaded hole 52 and an arm boss 53. Centered in the arm boss 53 of each unit-control shaft segment 35,36,37 is a threaded, adjustment hole 54. Also located in the free ends of the control shaft rocker pivot pins 9 for the drive end control shaft segment 34 and the first two unit-control shaft segments 35,36 are machined slots 55. These permit rigid yet adjustable connections (see FIGS. 10*b* and 11) between adjacent control shaft segments 34-37 permit individually setting the valve lift at each cylinder.

Figure 10G:
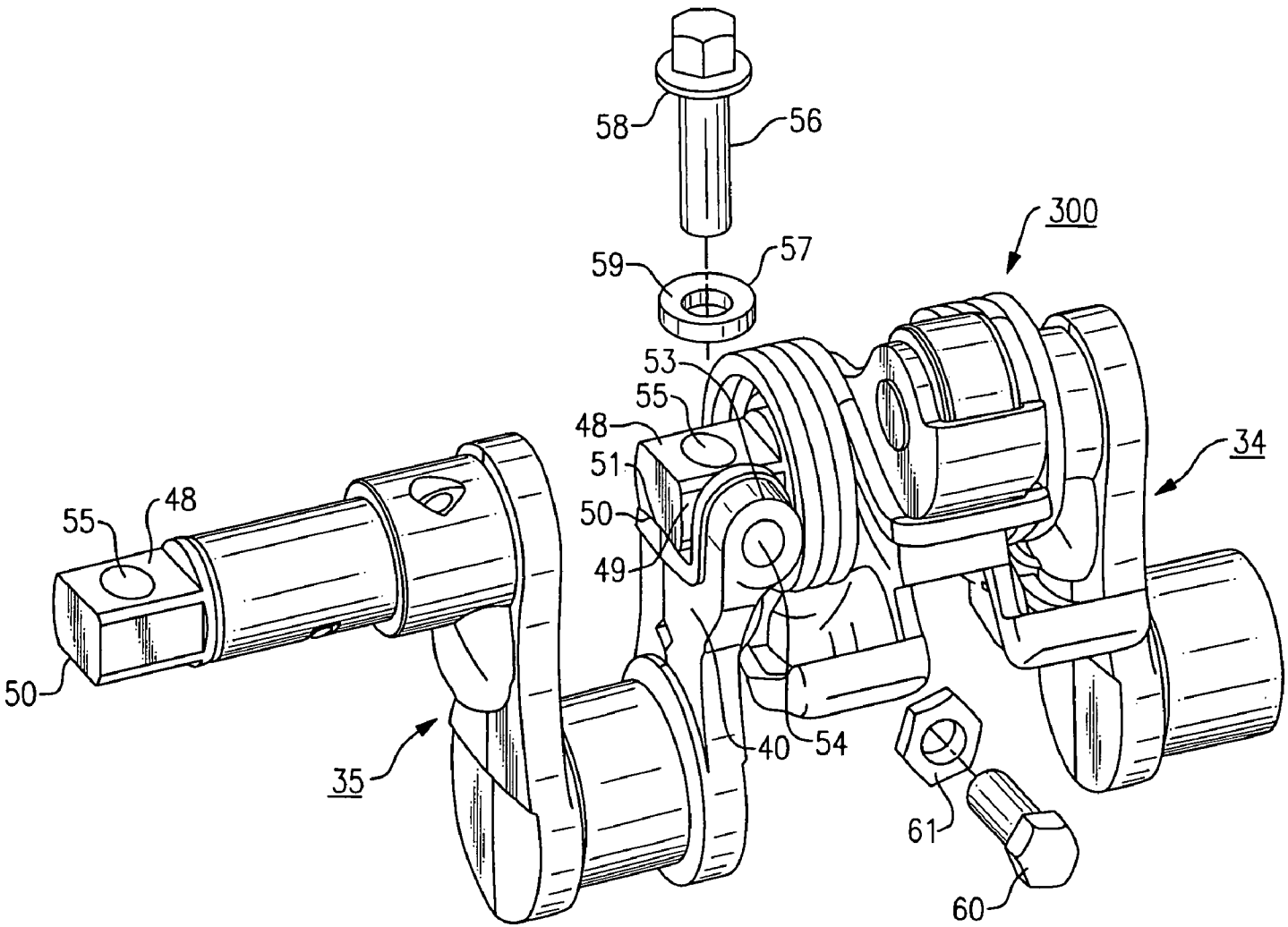
FIG. 10*a* is an exploded isometric view showing joining of the elements shown in FIG. 9*c;*
FIG. 10*b* is an exploded isometric view showing addition of a second VVA rocker sub-assembly onto the assembly shown in FIG. 10*a;*
Figure 10B:
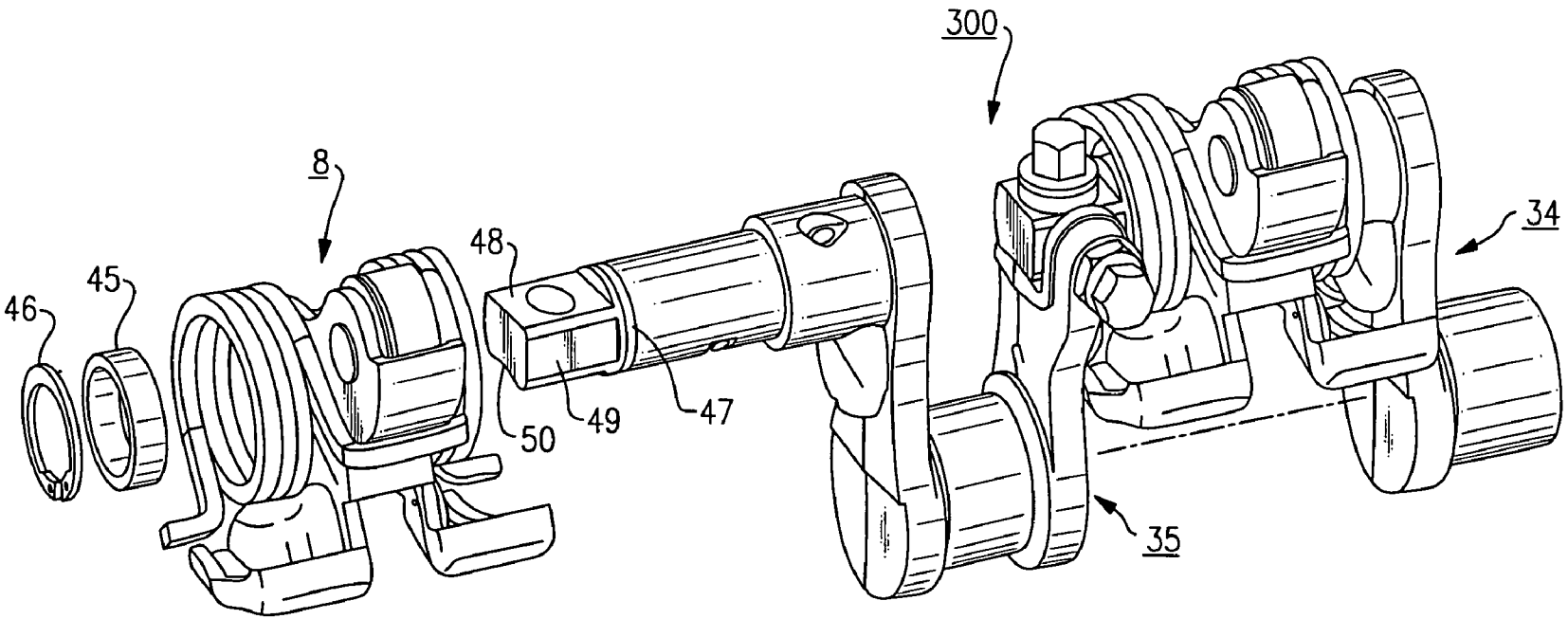

The completed control shaft segment sub-assemblies 300 (FIG. 9*c*) are bolted together (see FIGS. 10*b* and 11). The arched flange 51 of the first unit-control shaft segment sub-assembly 300 is placed into the arched pocket 50 of the completed drive end control shaft segment 34. A special, flanged head, clamping cap screw 56 feeds through a shaped washer 57 and the machined slot 55 of the drive end control shaft segment 34, engaging the blind, threaded hole 52 in the notched control arm 40 of first unit-control shaft segment 35. On the lower side of the clamping cap screw 56 head is a convex, spherical surface 58 that mates with a concave, spherical socket 59 ground into the top of each shaped washer 57. These spherical surfaces (see FIG. 10*a*) accommodate the upper flat 48 of the drive end control shaft segment 34 as it tilts relative to the axis of the clamping cap screw 56, during cylinder-to-cylinder valve lift adjustments.

FIG. 12 details a cross-section at the first joint of control shaft rocker pivot pin 9 to the notched control arm 40. The hex head, adjuster cap screw 60 is threaded through a standard, thin series, hex head jam nut 61 and the threaded, adjustment hole 54 in the arm boss 53. This adjuster cap screw 60 includes a convex, spherical tip 62 that rests against the machined flat 49 on the side of the drive end control shaft segment 34. Whenever the flanged head, clamping cap screw 56 is loosened for cylinder-to-cylinder valve lift adjustments, clockwise rotation of the adjuster cap screw 60 causes the spherical tip 62 to push the machined side flat 49 of the drive end control shaft rocker pivot pin 9 away from the arm boss 53 of the first unit-control shaft segment 35, resulting in a slight angular shift between these adjacent control arm segments.

After lift adjustment, the clamping cap screw 56 and jam nut 61 are tightened to lock the control shaft rocker pivot pin 9 of the drive end control shaft segment 34 to the first unit-control shaft segment 35, and the adjuster cap screw 60 in its arm boss 53, respectively. Connections between the next two, control shaft rocker pivot pins 9 and notched control arms 40 are similar.

The cross-section in FIG. 13 illustrates the last connection of the control shaft rocker pivot pin 9 to a notched control arm 40 between the third unit-control shaft segment 37 and the actuator control shaft segment 38. Since this connection does not require valve lift adjustments, it is different from the others. Here, a flanged cap screw 63 passes through a round clearance hole 64 in the free end of the cylinder 4 control shaft rocker pivot pin 9 and anchors into the blind threaded hole 52 of the last notched control arm 40. This is followed up with a second short flanged head cap screw 65 that feeds through another clearance bolt hole 66 centered in the final arm boss 53 and engages a threaded hole 67 in the side flat 49 of the last control shaft rocker pivot pin 9.

A beneficial feature of the described VVA system is that the control shaft assembly 1 is inherently biased toward the idle, or low load, position by the return springs 23. This can best be seen in FIGS. 2*a* and 2*b*. Regardless of control shaft 1 load position or cylinder number, each helical torsion return spring 23 is always forcing the rocker subassembly 8 to maintain vital contact between each rocker roller 7 and its cam lobe 4 on the input camshaft 2. Likewise, since return springs 23 are grounded through their end hooks 42 to the control shaft assembly 1, instead of into the cylinder head as in the prior art, they also tend to rotate the control shaft arms 3, 40 in a clockwise direction relative to the locations of their line-bored shank pins 25, 26 and 27 in the cylinder head. As a result, at low engine speeds where inertia forces are not a concern, the control shaft actuator (not shown) needs only to provide torque at the actuator end shank pin 27 in the counterclockwise direction to maintain a desired valve lift.

System 200 utilizes this inherent control shaft biasing to facilitate minute valve lift adjustments that are required to equalize low engine speed, light load, cylinder-to-cylinder gas flows in gasoline or Diesel applications. FIGS. 14*a-d* convey a unique lift adjustment scheme that system 200 provides for such applications, as follows.

After a cylinder head has been assembled with system 200, the engine manufacturer has several options to balance the cylinder-to-cylinder gas flow. The system flow balancing scheme provides the engine manufacturer a unique flexibility to choose the best method to fit its needs. Gas flow can be adjusted either on an individual cylinder head in a flow chamber environment, or on a completed running engine.

Assembly line calibration can be carried out on an automated test stand, with either a precision air flow rate meter for calibrating individual completed cylinder heads or with a bench type combustion gas analyzer for calibrating fully assembled engines. For balancing individual cylinder heads, lift can be adjusted either statically to match a desired steady-state, steady flow rate target with the camshaft fixed, or dynamically with the camshaft spinning, by measuring the time-averaged flow rate for each cylinder. However, system 200 can also be adjusted dynamically in a repair garage with a running engine, using cylinder-to-cylinder exhaust gas analysis techniques with a portable fuel/air ratio analyzer.

Figure 14A:
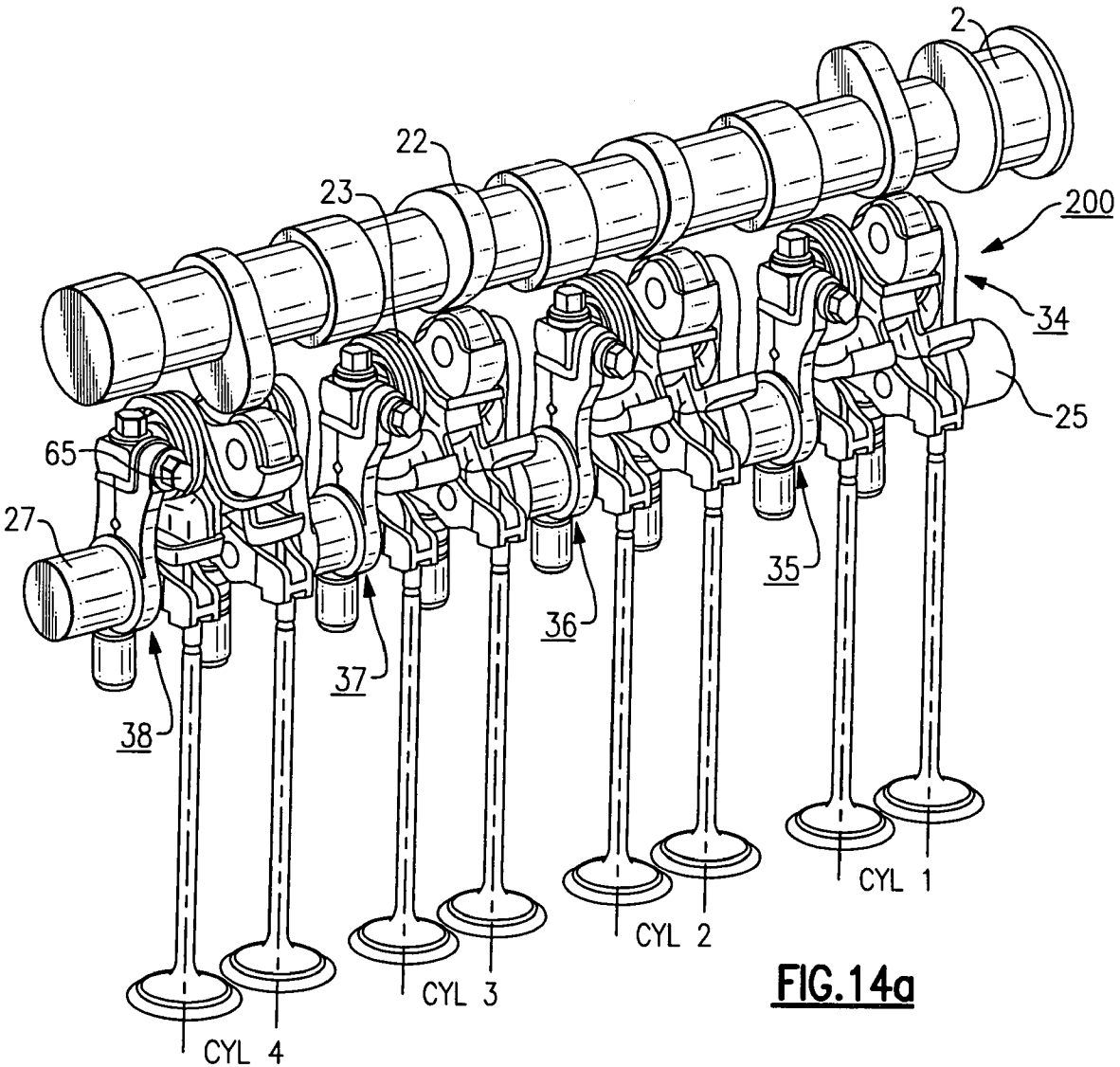
FIGS. 14*a-d* are isometric views like that shown in FIG. 4 but viewed from the opposite side, showing a sequence of air flow adjustment steps for tuning air flow to each individual engine cylinder.
Figure 14B:
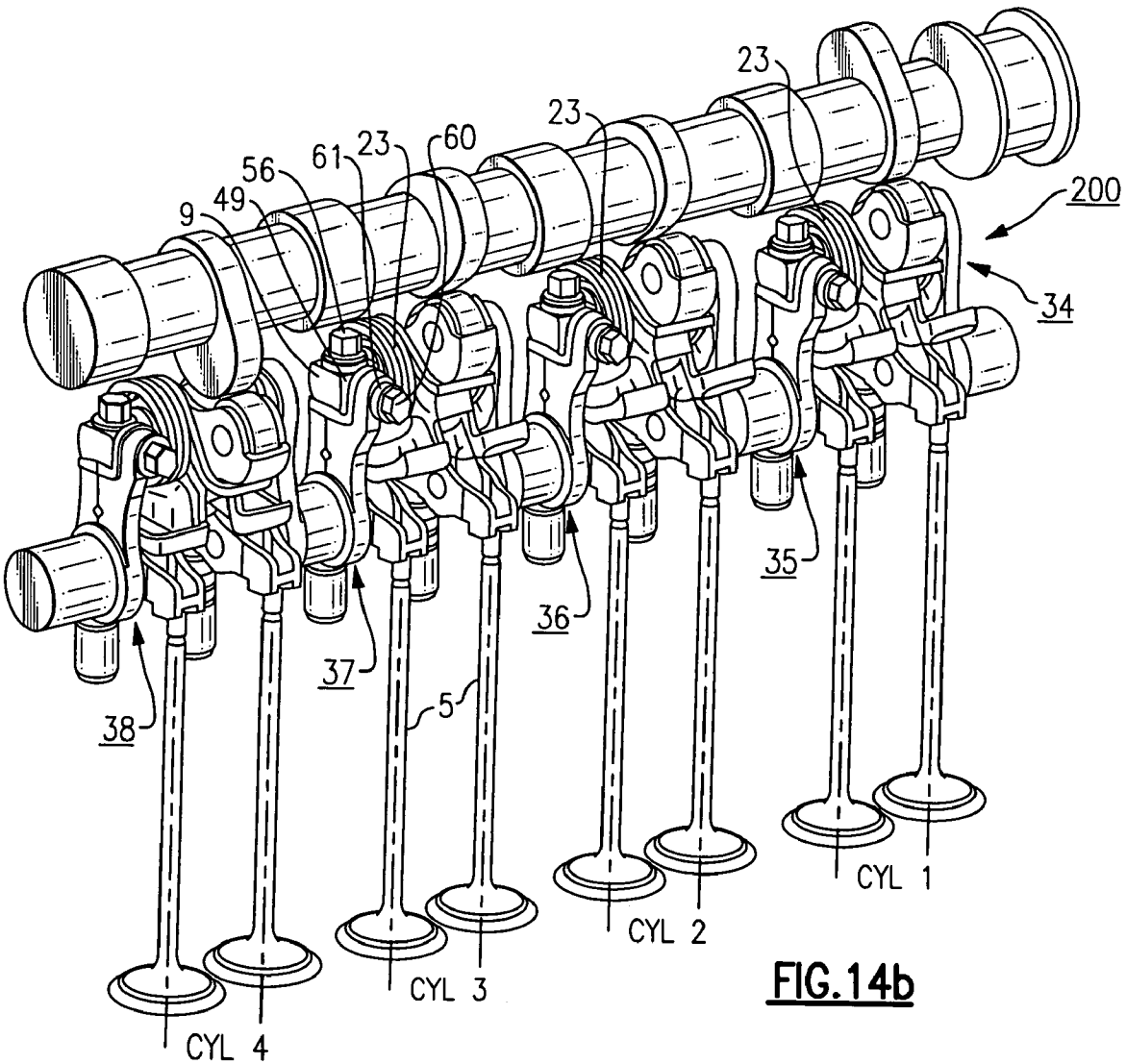
Figure 14C:
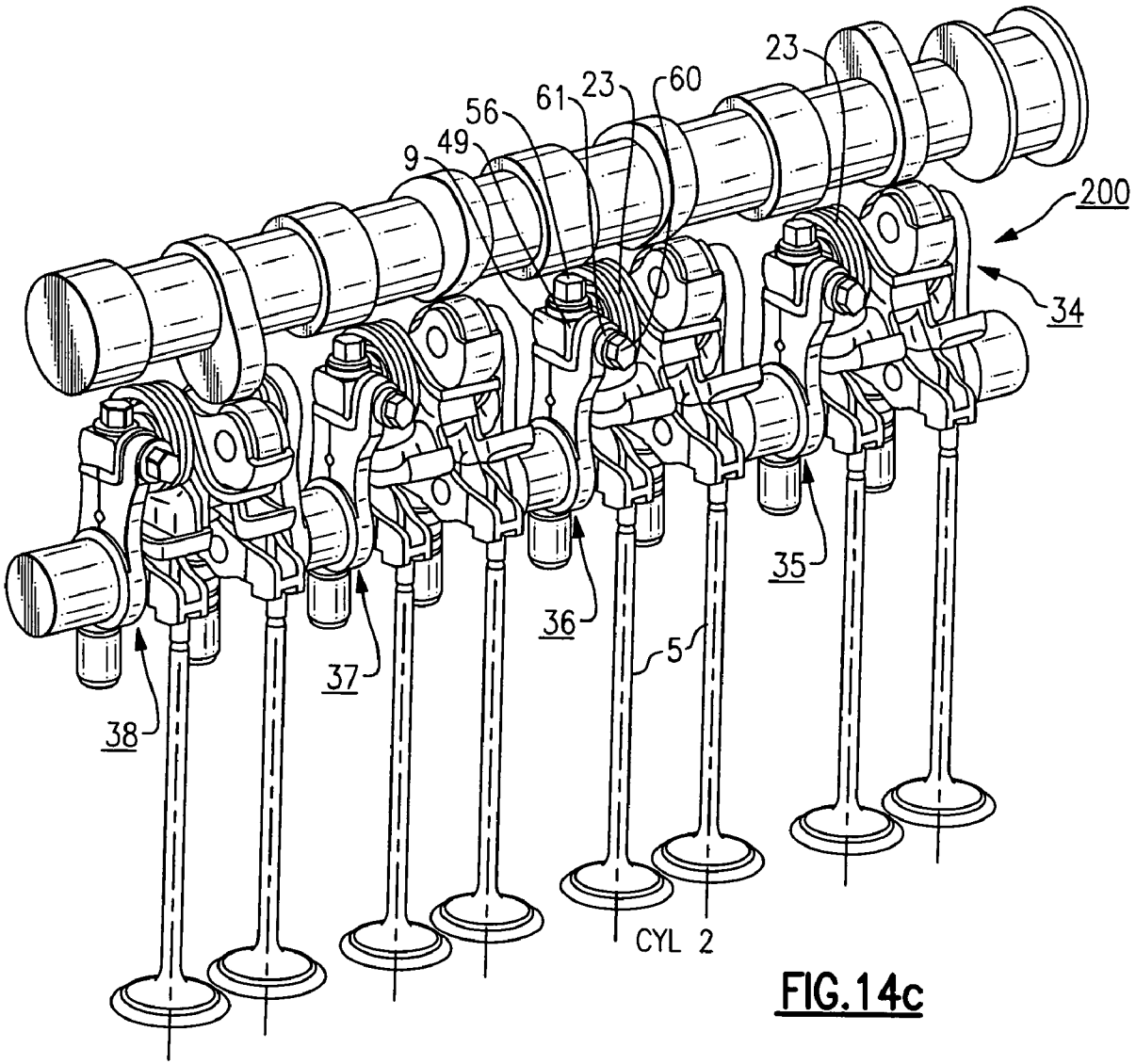
Figure 14D:
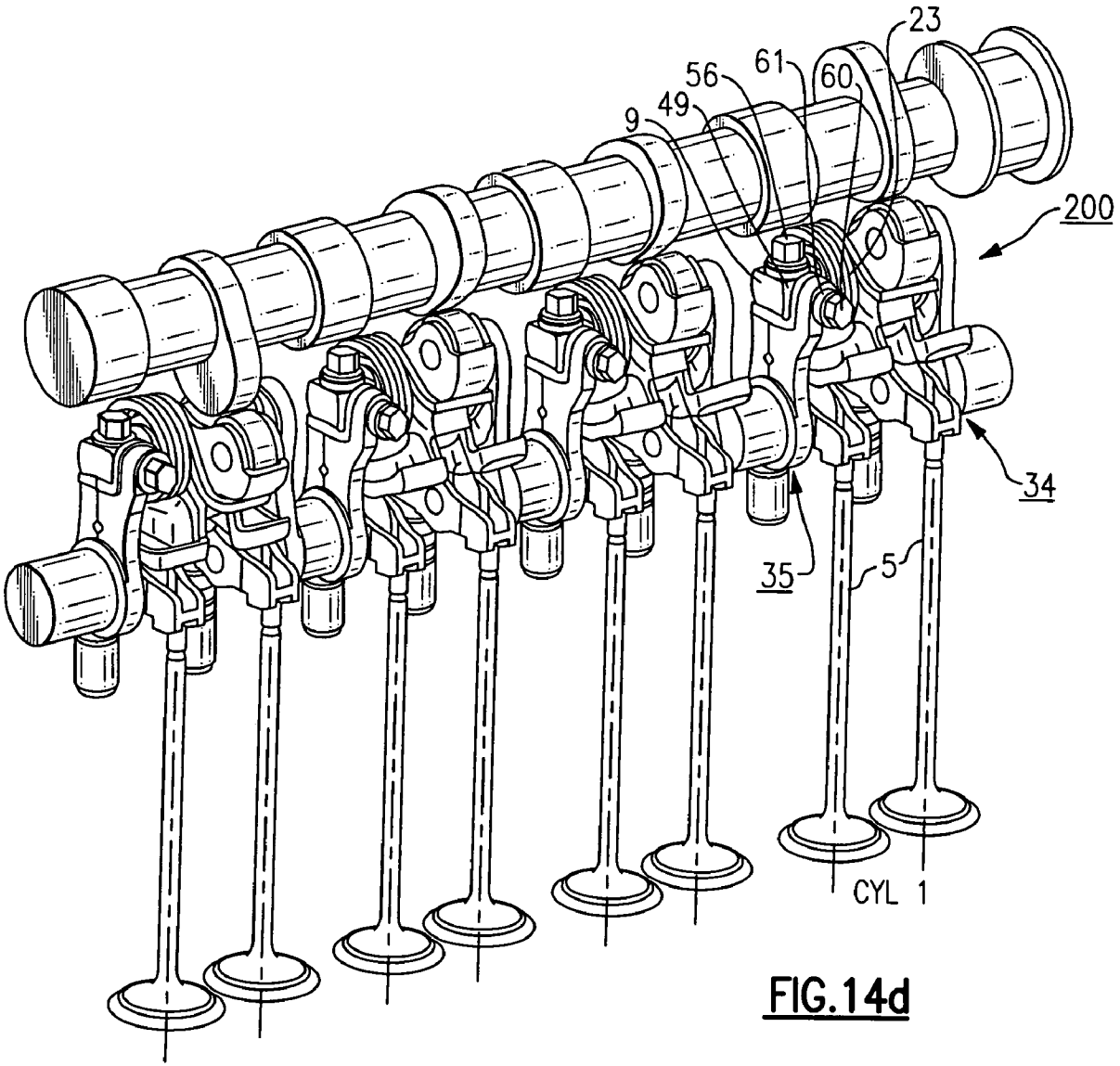

In the following adjustment procedure, it is assumed that a common, in-line 4 cylinder head (as shown in FIG. 4 or 14*a-d*) requires cylinder-to-cylinder intake air flow calibration. In either of the above scenarios, the balancing would start at cylinder 4 (FIG. 14*a*) and proceed sequentially down through cylinder 1 (FIG. 14*d*). At cylinder 4, under closed-loop control, the actuator voltage is varied until the angular position of the entire control shaft assembly 1 causes either the airflow or the Fuel/Air (F/A) ratio at cylinder 4 to match a target value. Once the flow rate or F/A ratio falls within a desired bandwidth at cylinder 4, the actuator position is recorded through a system position sensor (not shown) and maintained steadily from that point on. Note that while adjusting cylinder 4, all five control shaft segments 34-38 will rotate together, and that the actuator effectively "sees" the combined holding torque for all four cylinders.

Next, at cylinder 3 (see FIG. 14*b*), the adjuster jam nut 61 at the adjuster cap screw 60 and the clamping cap screw 56 between cylinders 3 and 4 are loosened slightly. While maintaining the same actuator position previously identified at cylinder 4, the adjuster cap screw 60 between cylinders 3 and 4 is rotated either clockwise or counter-clockwise, as required, to adjust the intake valve 5 flow rate for cylinder 3. Rotating the adjuster cap screw 60 will cause the drive end control shaft segment 34 for cylinder 1 and the unit-control shaft segments 35,36 for cylinders 2 and 3 to rotate relative to the unit-control shaft segment 37 for cylinder 4 by pushing against the ground side flat 49 at the free end of the cylinder 3 control shaft rocker pivot pin 9 and the resistance presented by the return springs 23 for cylinders 1, 2 and 3. When cylinder 3's airflow or F/A ratio falls within the desired bandwidth for the target, the clamping cap screw 56 and adjuster jam nut 61 are tightened to lock in the cylinder 3 adjustment.

In a similar fashion, the above adjustment procedure is repeated at cylinders 2 and 1 (see FIGS. 14*c* and 14*d*, respectively), in that order, by first loosening the appropriate adjuster jam nut 61 and clamping cap screw 56, turning the adjuster cap screw 60 to meet the flow rate bandwidth and then, tightening the adjuster jam nut 61 and clamping cap screw 56.

The flow adjustment resolution of the system is fine enough to balance the cylinder-cylinder airflow at an engine idle condition. One revolution of the adjuster cap screw 60 produces approximately a 0.2 mm change in valve lift. Preferably, a total adjustment range of about ±0.3 mm is provided at each joint.

The beauty of this adjustment scheme is the way in which the control shaft assembly 1 continues to reflect the total torque applied by the return springs 23 at each cylinder, at all times during the adjustment procedure. In other words, the adjustment procedure inherently compensates for any natural twisting or deflection of the control shaft assembly 1 due to the load applied by the return springs 23.

After the adjustments are completed at cylinder 1, then the automated stand can check to see that all cylinders are meeting their targeted flows. If any cylinder is off the target, a portion or all of the procedure can be repeated.

Figure 15:
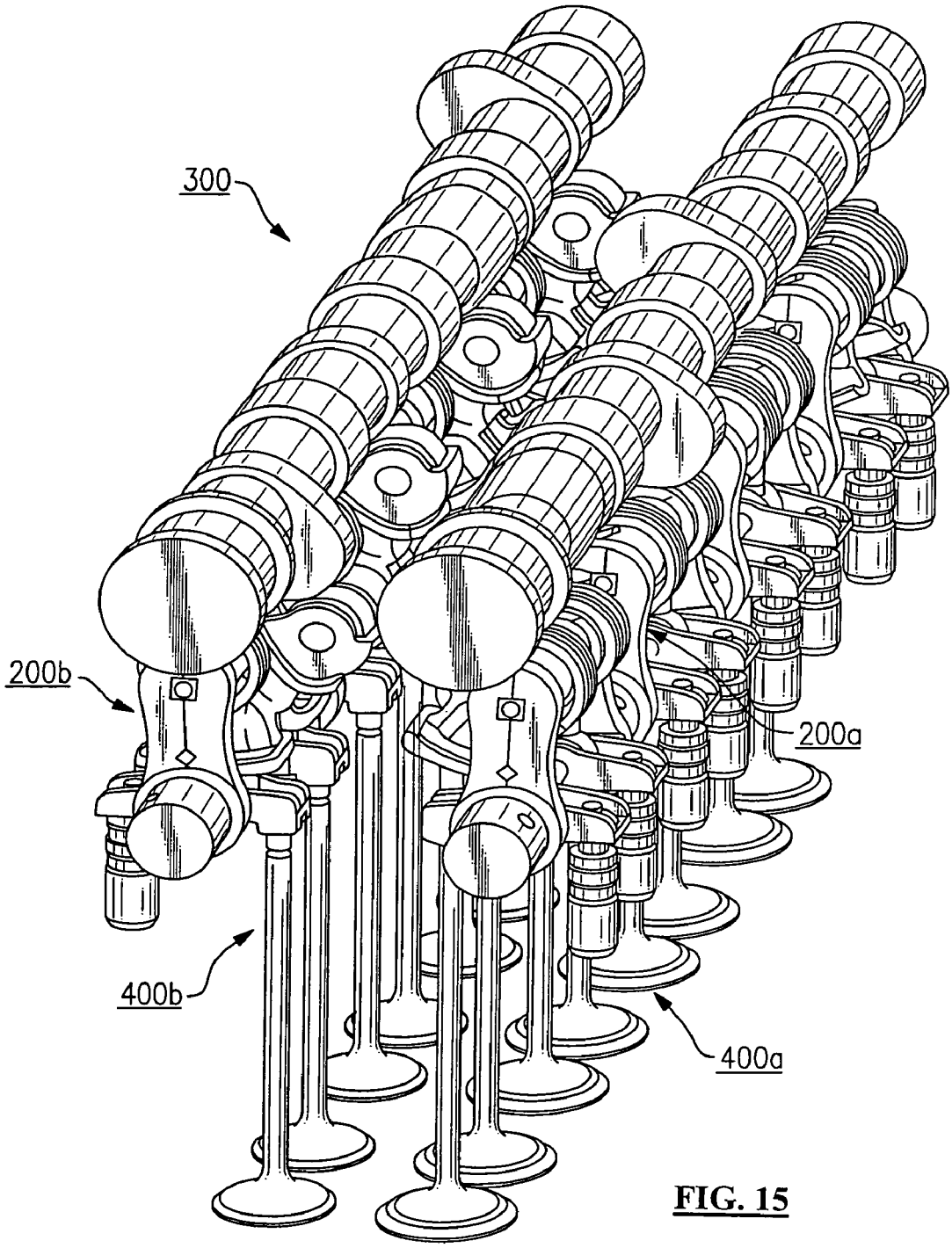
FIG. 15 is an isometric view showing VVA means as shown in FIG. 11 installed on all of the intake valves and all of the exhaust valves of an inline four cylinder engine.

Referring now to FIG. 15, a complete valvetrain assembly 300 utilizing system 200 is shown for an inline bank of cylinders (4 are shown) having an intake camshaft and an exhaust camshaft, and having two intake valves and two intake roller finger followers for each cylinder, and having two exhaust valves and two exhaust roller finger followers for each cylinder, wherein a first VVA system 200*a* is incorporated in the intake valvetrain 400*a* and a second VVA system 200*b* in incorporated in the exhaust valvetrain 400*b*.

Figure 16:
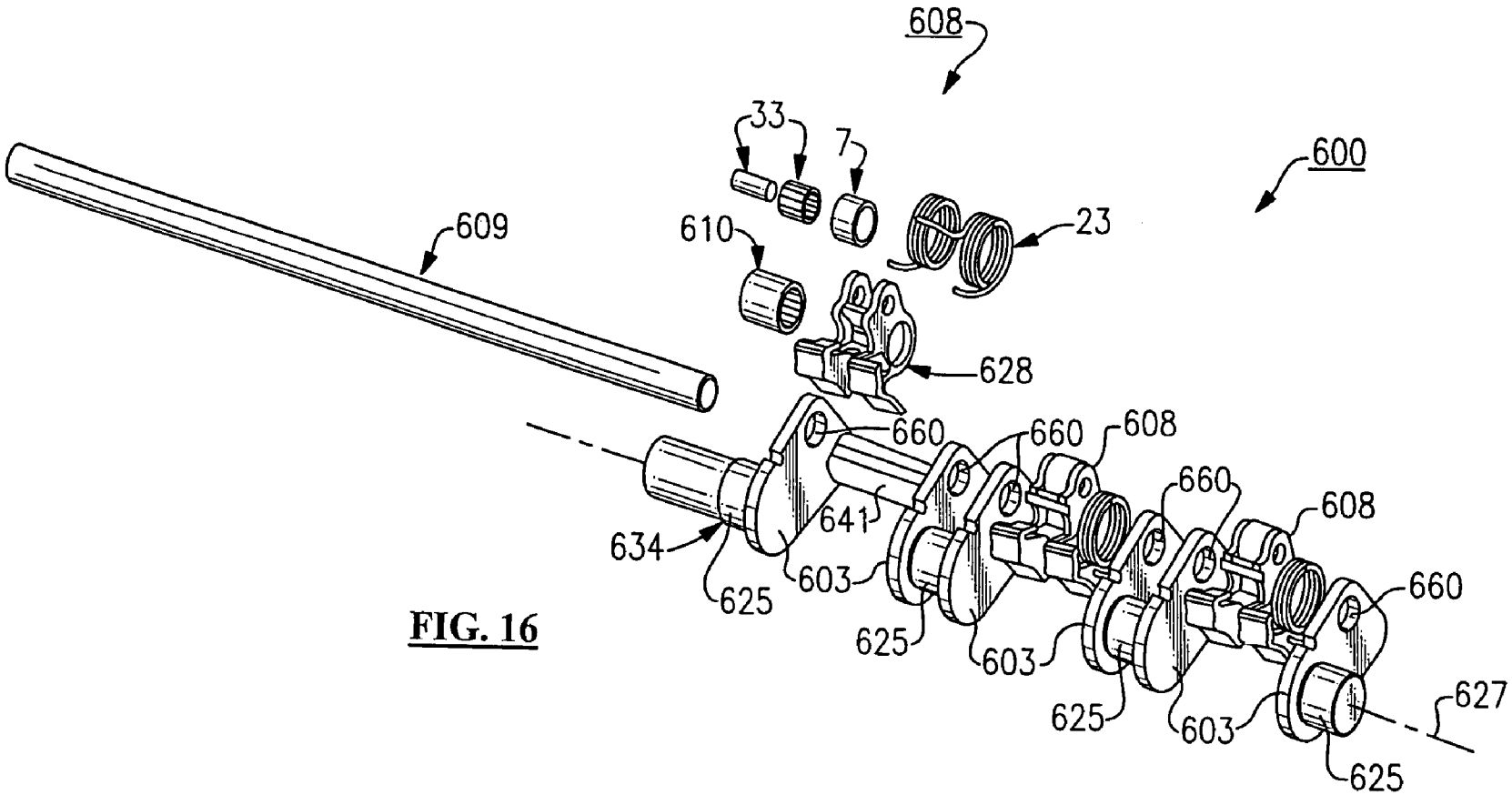
FIG. 16 is an exploded isometric view of rocker sub-assemblies for a plurality of valves (three) in accordance with the invention.

Referring now to FIG. 16, a VVA sub-assembly 600, in accordance with the present invention, having a control shaft formed as a single piece crankshaft unit, is shown. Subassembly 600 comprises a carrier control shaft 634, a rocker pivot shaft 609, and three rocker sub-assemblies 608.

In embodiment 600, carrier control shaft 634 replaces the above described plurality of bolted together segments 34,35, 36,37,38 forming a single control shaft for system 200. The individual crank elements in the form of pivot arms 603 and shank pins 625 are joined by bridges 641. The previous plurality of pivot pins 9 are replaced by a single rocker pivot shaft 609 that extends through bores 660 in carrier control shaft 634 to pivotably support rocker assemblies 608.

Each rocker subassembly 608 comprises a rocker frame 628 substantially the same as rocker frame 28 except that provision is made for replacement of bronze bearing insert 10 with a needle bearing assembly 610 to reduce friction of rocker subassembly 608 on rocker pivot shaft 609. Rocker roller 7, with shaft and bearing 33 is unchanged, as is return spring 23.

Figure 17:
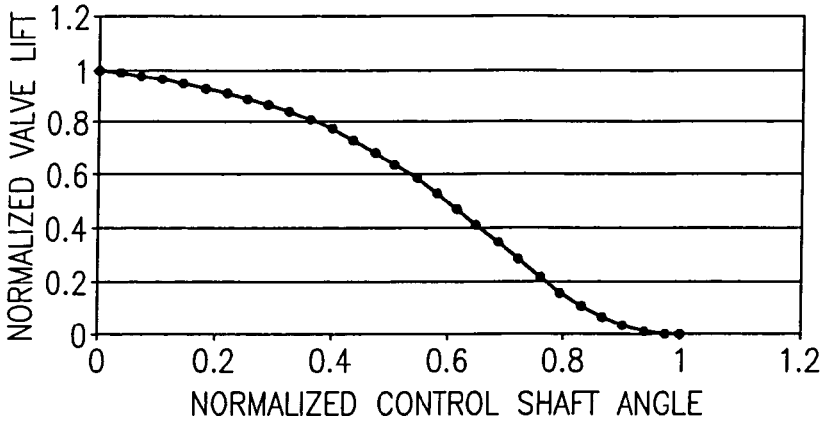
FIG. 17 is a graph showing valve lift as a function of control shaft rotation angle for a VVA assembly in accordance with the invention.

In operation, carrier control shaft rotates about the axis 627 of shank pins 625, thereby displacing rocker pivot shaft 609 through an angle 202 as shown in FIGS. 3*a*,3*b* which alters the timing and lift on all the associated valves as described above. The relationship between control shaft angle 202 and the resulting lift of the valves is shown in FIG. 17.

Figure 18:
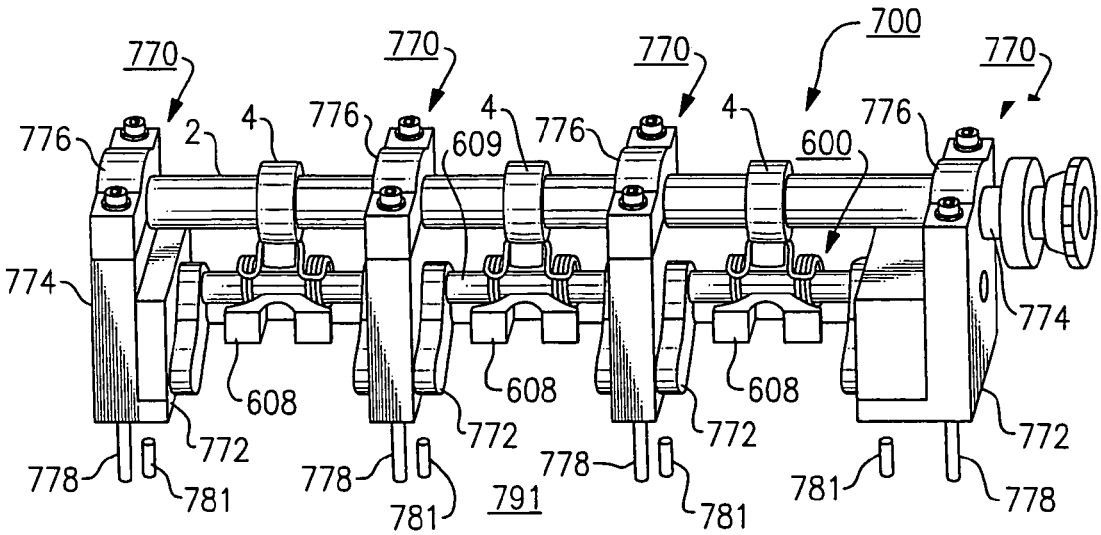
FIG. 18 is an isometric view of a VVA assembly in accordance with the invention for mounting onto an engine head.

Referring to FIG. 18, a first embodiment 700 of a VVA assembly incorporating VVA sub-assembly 600 includes a plurality of free-standing arbors 770 spaced apart along the length of VVA sub-assembly 600. Arbors 770 are formed in at least three sections, having a base section 772 for receiving subassembly 600 in bottom bearing (not visible) for supporting shank pins 625 (not visible); a central section 774 for completing the journals for shank pins 625 and having bottom bearings for camshaft 2; and bearing caps 776 for completing the bearings for the camshaft. An arcuate slot (not visible) is provided in each arbor 770 to accommodate the arcuate motion of rocker pivot shaft 609 around shank pins 625. The bearings in arbors 770 are formed to provide the proper relationship of cam lobes 4 to rocker sub-assemblies 608. Each arbor 770 includes bores for screws or studs 778 to attach the individual arbors 770 to an engine head 791, and to clamp base section 772, central section 774 and bearing caps 776 in tight arrangement after screws/studs 778 are tightened. Dowel pins 781 and receiving holes for the dowel pins (not shown) may be formed in the lower surface of base section 772 and the mating surface of engine head 791 for accurate alignment of arbors 770 to the head.

Figure 19:
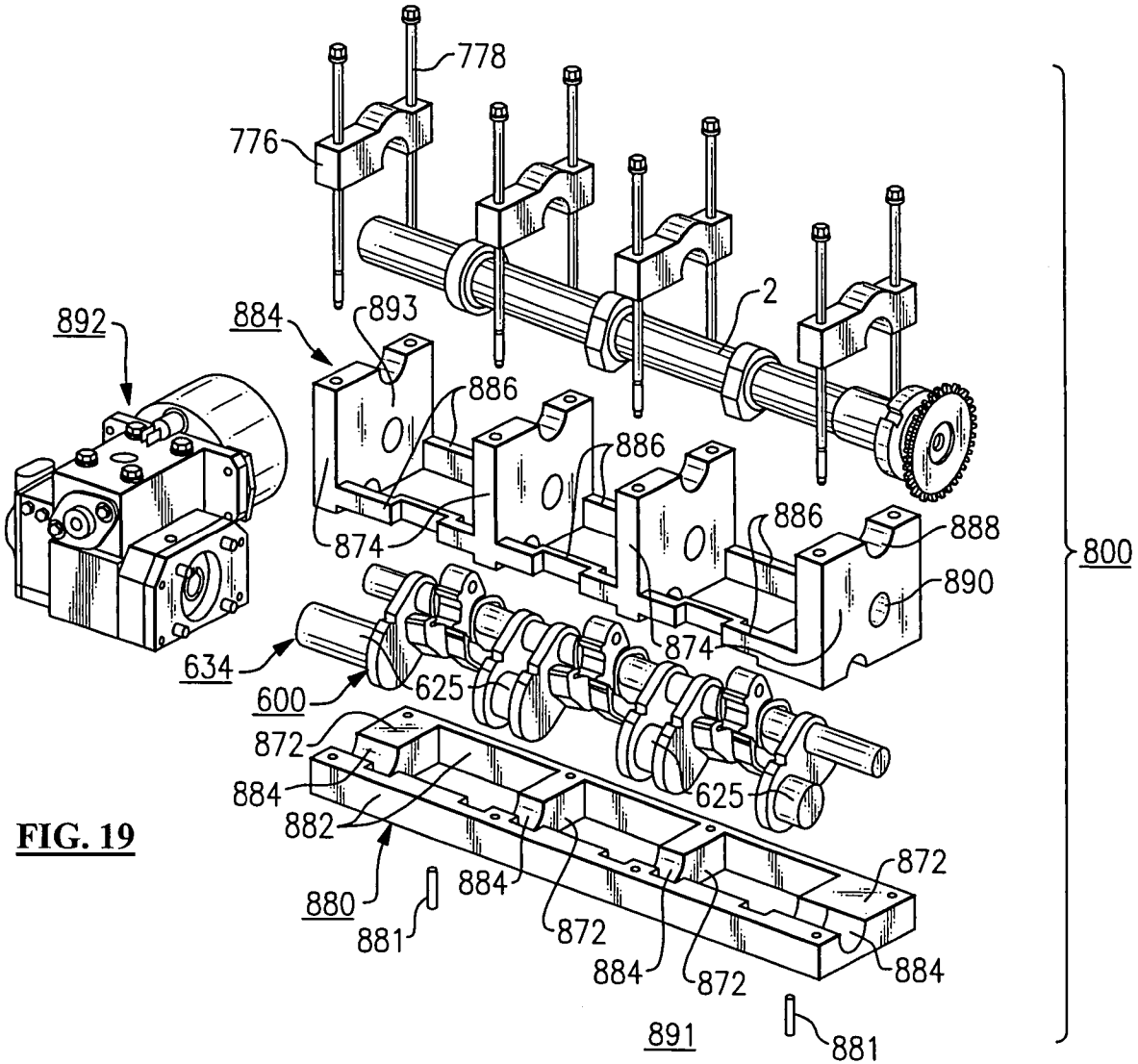
FIG. 19 is an exploded isometric view of another embodiment of a VVA assembly in accordance with the invention for mounting onto an engine head.
Figure 20:
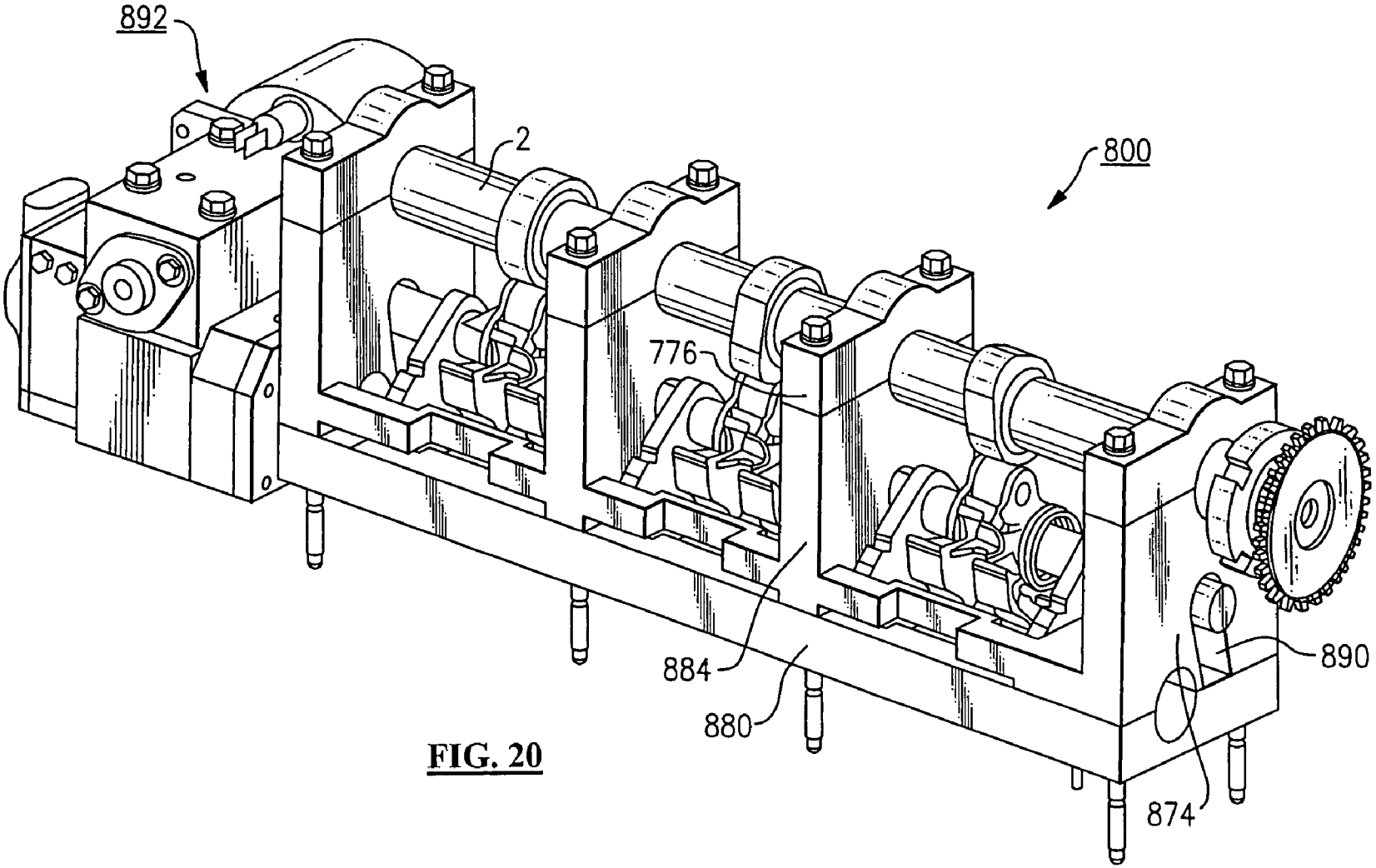
FIG. 20 is a first isometric view of the embodiment, shown in FIG. 19, after assembly.
Figure 21:
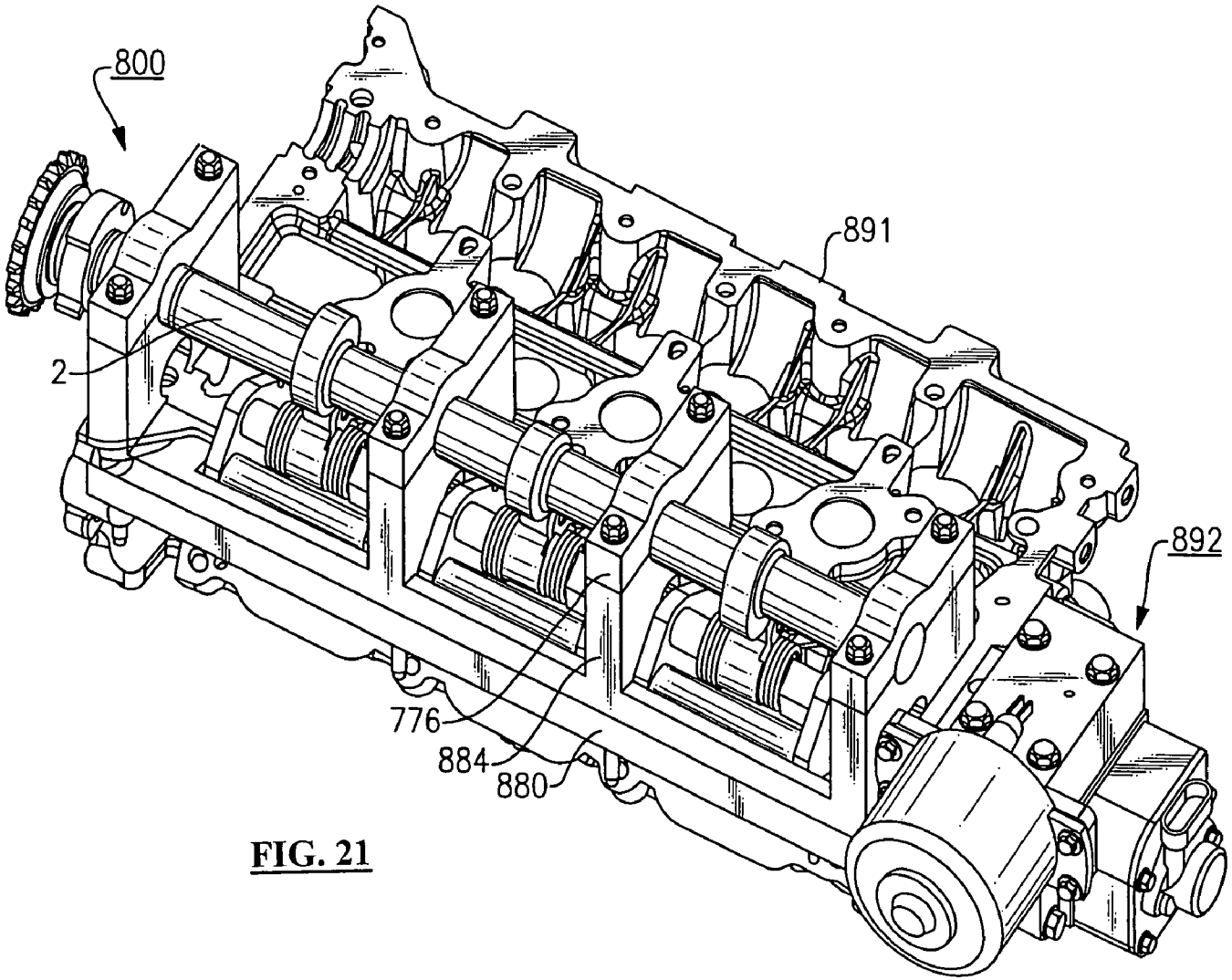
FIG. 21 is a reverse isometric view of the embodiment shown in FIG. 19, shown attached to an engine head for use.

Referring to FIGS. 19 through 21, a second embodiment 800 of a VVA assembly incorporating VVA sub-assembly 600 comprises a unitized carrier module of arbor elements that replaces the plurality of free-standing arbors 770 spaced apart along the length of VVA sub-assembly 600 shown in embodiment 700. An advantage of such a unitized carrier module is that the arbor elements are automatically positioned with respect to one another, and the entire assembly has great torsional rigidity.

A base module 880 includes base sections 872, corresponding to base sections 772 in embodiment 700, joined by runners 882, each base section 872 including half-journals 884 for supporting shank pins 625 of VVA sub-assembly 600. Base module 880 may also include dowel pins 881 extending from the undersurface thereof to provide accurate alignment of the entire VVA assembly 800 with an engine head 891.

A main body module 884 includes a plurality of arbor center sections 874 corresponding to center sections 774 in embodiment 700, sections 874 being connected by runners 886, each arbor center section including upper half-bearings for shank pins 625, bottom half-bearings 888 for supporting camshaft 2, and slotted openings 890 for rocker pivot shaft 609. In one aspect of the invention, the width 893 of one or more slotted openings 890 may be sized to serve as positive end stops for shaft 609 as shaft 609 sweeps through its desired full arcuate path. Note that the slotted openings may also be formed for manufacturing convenience as slots 890' as extending to the edge of arbor center sections 874, as shown in FIG. 19.

Bearing caps 776 and screws/studs 778 are shown in embodiment 700. Note that the use of single, straight-through fasteners for connecting together the elements of the VVA assembly 700,800 and simultaneously attaching the assembly to an engine head minimizes the number of fasteners required to assemble the module to an engine head.

Lubrication supply passages (not visible) in embodiments 700,800 are formed to mate with oil galleries in the engine and to supply oil to the camshaft and control shaft bearings; rocker pivot shaft 609 may or may not rotate within crank elements 603.

A rotary actuator unit 892 attaches to a shank pin end 625 of carrier control shaft 634.

Figure 22:
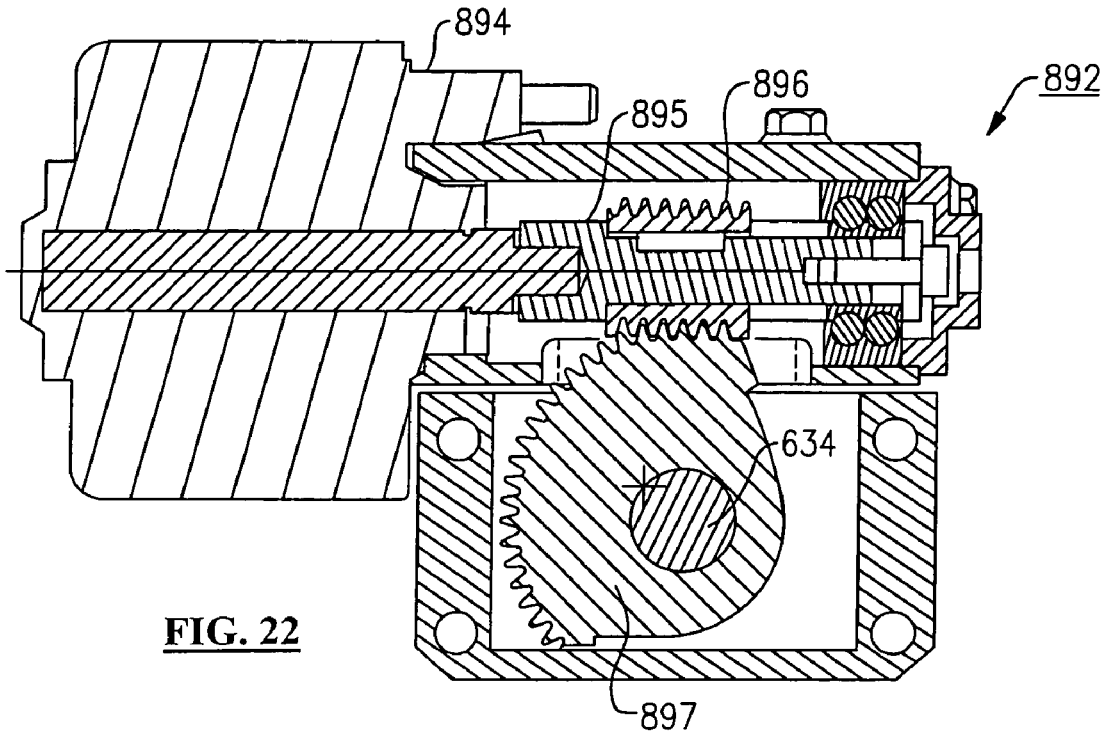
FIG. 22 is an elevational cross-sectional view of the electromechanical actuator shown in FIG. 21.
Figure 23:
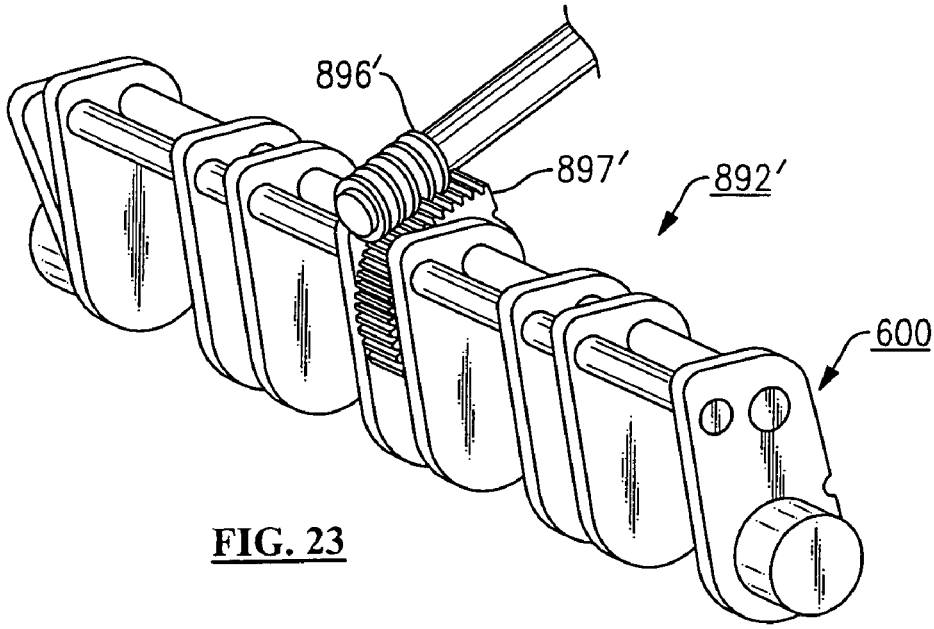
FIG. 23 is an isometric view of a portion of another embodiment of an actuator.

Referring to FIG. 22, in one aspect of the invention, actuator unit 892 comprises a reversible electric motor 894 having a drive shaft extension 895 keyed to a worm 896 that engages a gear 897 keyed to carrier control shaft 634. A worm gear drive is preferred for having a large contact surface between the gears and virtually zero mechanical lash, thereby assuring accurate valve lift and timing. Referring to FIG. 23, in an alternate worm gear embodiment 892', the gear 897' is mounted directly on VVA sub-assembly 600 at an intermediate axial location thereof and is engaged by a worm gear and shaft 896' extending orthogonal to VVA sub-assembly 600.

Some advantages of the presently-disclosed VVA assemblies 700,800 are:

a) helping engine manufacturers to minimize VVA assembly cycle time by avoiding complicated VVA sub-assembly process. VVA sub-assemblies 700,800 can be assembled by a supplier, tested, and then shipped to an engine manufacturer ready for simple installation as a module by bolting to an engine head;

b) allowing multi-engine configuration production on a single engine production line. OEMs tend to apply prior art costly VVA systems on a limited production volume rather than on all engines produced; however, it is challenging to allow a single engine production line to produce many different versions of engine configuration, such as continuous valve train, continuous VVA, 2-step VVA, or valve deactivation. A modular VVA system module in accordance with the invention helps engine manufacturers to produce many different valve train configurations engines easily in the same engine production line by simply assembling different VVA modules to a common cylinder head design; and c) improving the positioning and torsional stiffness of a VVA assembly, thus improving precision of assembly and operation, and reducing wear.

While the air tuning adjustment feature and sequence as explained above and depicted in FIGS. 14 *a-d* are made in reference to system 200, it is understood that the feature and sequence are equally applicable to each additional embodiment disclosed herein and may be readily adapted to those embodiments and other variations of the embodiments without undue experimentation by one skilled in the art.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A variable valve actuation system for inclusion in an internal combustion engine between a camshaft and a plurality of roller finger followers to variably actuate a plurality of associated engine combustion valves to vary at least one of a timing of valve opening, timing of valve closing, an amplitude of valve lift, or duration of valve lift, said system including a variable valve actuation sub-assembly comprising:

a) a rocker pivot shaft having a first axis disposed parallel to an axis of rotation of said camshaft defined as a second axis;

b) a plurality of rocker sub-assemblies pivotably disposed on said rocker pivot shaft for rotation about said first axis, each of said rocker sub-assemblies having a contact surface for following a lobe of said camshaft and having an output cam for engaging a one of said plurality of roller finger followers; and c) a control shaft having a plurality of crank elements extending from a control shaft axis, defined as a third axis parallel to said first and second axes, said crank elements being supportive of said rocker pivot shaft at a radial distance from said control shaft axis.

2. A system in accordance with claim 1 further comprising an actuator for rotating said control shaft about said third axis to vary the distance of said rocker pivot shaft axis from said camshaft axis to vary the actions of said output cams upon respective of said roller finger followers to vary said at least one of the timing, lift or duration of respective of said valves.

3. A system in accordance with claim 2 wherein said actuator comprises an electromechanical rotary actuator operationally connected to said control shaft.

4. A system in accordance with claim 3 wherein said electromechanical rotary actuator comprises a worm and a gear.

5. A system in accordance with claim 1 wherein at least one of said rocker sub-assemblies further comprises:

a) a body;

b) a first bearing disposed in first openings in said body for receiving said rocker pivot shaft; and c) second openings in said body for receiving a supporting shaft for said roller.

6. A system in accordance with claim 5 further comprising a second bearing disposed in said second openings between said body and said supporting shaft.

7. A system in accordance with claim 1 further comprising at least one arbor for supporting and positioning said camshaft, said rocker pivot shaft, and said control shaft to assure proper positioning of said rocker pivot shaft with respect to said camshaft and said control shaft.

8. A system in accordance with claim 7 wherein said at least one arbor comprises a plurality of discrete arbors spaced apart along said variable valve actuation sub-assembly for mounting onto said engine.

9. A system in accordance with claim 7 wherein said at least one arbor is a unitized carrier module of arbor elements.

10. A system in accordance with claim 9 wherein each of said arbor elements comprises:

a) a base module including a plurality of base sections joined by first runners;

b) a main body module including a plurality of arbor center sections joined by second runners; and c) a bearing cap for each main body module.

11. A multiple-cylinder internal combustion engine comprising a variable valve actuation system disposed between a camshaft and a plurality of roller finger followers to variably actuate a plurality of associated engine combustion valves to vary at least one of a timing of valve opening, a timing of valve closing, an amplitude of valve lift, or a duration of valve lift.

wherein said system includes a variable valve actuation sub-assembly having a rocker pivot shaft having a first axis disposed parallel to an axis of rotation of said camshaft, defined as a second axis, a plurality of rocker sub-assemblies pivotably disposed on said rocker pivot shaft for rotation about said first axis, each of said rocker sub-assemblies having a contact surface for following a lobe of said camshaft and having an output cam for engaging a one of said plurality of roller finger followers, and a control shaft having a plurality of crank elements extending from a control shaft axis, defined as a third axis parallel to said first and second axes, said crank elements being supportive of said rocker pivot shaft at a radial distance from said control shaft axis.

12. An engine in accordance with claim 11 further comprising an actuator for rotating said control shaft about said third axis to vary the distance of said rocker pivot shaft axis from said camshaft axis to vary the actions of said output cams upon respective of said roller finger followers to vary said timing and lift of respective of said valves.

13. A system in accordance with claim 11, wherein said engine includes a plurality of cylinders, valves, cam lobes, and roller finger followers defining an inline bank of cylinders, and wherein said variable valve actuation sub-assembly is mounted on said engine for controlling the timing of at least a portion of said valves in said bank of cylinders.

* * * * *